US008245887B2

(12) United States Patent
Ohshima

(10) Patent No.: US 8,245,887 B2
(45) Date of Patent: Aug. 21, 2012

(54) CONTENT DISCHARGE MECHANISM FOR PUMP-TYPE CONTAINER AND PUMP-TYPE PRODUCT WITH CONTENT DISCHARGE MECHANISM

(75) Inventor: Yasuo Ohshima, Tokyo (JP)

(73) Assignee: Mitani Valve Co. Ltd., Tokyo (JP)

( * ) Notice: Subject to any disclaimer, the term of this patent is extended or adjusted under 35 U.S.C. 154(b) by 959 days.

(21) Appl. No.: 12/162,206

(22) PCT Filed: Jul. 13, 2006

(86) PCT No.: PCT/JP2006/313984

§ 371 (c)(1),
(2), (4) Date: Jul. 25, 2008

(87) PCT Pub. No.: WO2007/086156

PCT Pub. Date: Aug. 2, 2007

(65) Prior Publication Data

US 2009/0008415 A1 Jan. 8, 2009

(30) Foreign Application Priority Data

Jan. 26, 2006 (JP) ..... 2006-017996

(51) Int. Cl.
*B67D 7/58* (2010.01)

(52) U.S. Cl. ..... 222/383.1; 239/333; 222/375; 222/380; 222/494; 222/497

(58) Field of Classification Search ..... 239/333; 222/380, 383.1, 401–402, 494–497, 321.2, 222/321.7–321.9, 375, 402.2
See application file for complete search history.

(56) References Cited

U.S. PATENT DOCUMENTS

| | | | | | |
|---|---|---|---|---|---|
| 5,425,476 | A * | 6/1995 | Montaner et al. | ..... | 222/383.1 |
| 5,636,768 | A * | 6/1997 | Yamada | ..... | 222/383.1 |
| 5,641,097 | A * | 6/1997 | Renault et al. | ..... | 222/321.2 |
| 5,709,325 | A * | 1/1998 | Renault et al. | ..... | 222/383.1 |
| 5,839,621 | A * | 11/1998 | Tada | ..... | 222/383.1 |
| 6,015,067 | A * | 1/2000 | Lang et al. | ..... | 222/153.13 |
| 6,705,493 | B1 * | 3/2004 | Mijers | ..... | 222/321.7 |
| 6,779,690 | B2 * | 8/2004 | Masuzzo et al. | ..... | 222/321.4 |
| 6,824,021 | B2 * | 11/2004 | Masuzzo et al. | ..... | 222/321.7 |
| 2006/0027607 | A1 * | 2/2006 | Schultz | ..... | 222/383.1 |

FOREIGN PATENT DOCUMENTS

| | | | |
|---|---|---|---|
| JP | 53-67103 | Y | 6/1978 |
| JP | U 1988/176570 | Y | 11/1988 |
| JP | U 1992/17855 | Y | 2/1992 |
| JP | U 1986/83479 | Y | 6/1996 |
| JP | 10-43646 | Y | 2/1998 |
| JP | 11-57546 | Y | 3/1999 |

* cited by examiner

*Primary Examiner* — Kevin P Shaver
*Assistant Examiner* — Andrew P Bainbridge
(74) *Attorney, Agent, or Firm* — Lucas & Mercanti, LLP

(57) ABSTRACT

A content discharge mechanism for a container with a pump has a discharge outlet that is fixed in position. The device has an operation button and a cylindrical piston that move as one, as well as a ball valve that rests on a seat. The ball valve opens as the cylindrical piston retracts after an actuation to allow more fluid into the upstream passage chamber. A downstream passage with a valve for dispensation fluidly communicates with the upstream passage through a hole. As the cylindrical piston and its seal slide over the hole, the discharge from the downstream passage stops.

6 Claims, 11 Drawing Sheets

CONTENT DISCHARGE MECHANISM FOR PUMP-TYPE CONTAINER AND PUMP-TYPE PRODUCT WITH CONTENT DISCHARGE MECHANISM

TECHNICAL FIELD

The present invention relates to a content discharge mechanism of a pump type container and more particularly, to a content discharge mechanism capable of preventing the position of a content discharge outlet from moving in response to an operation part upon setting operation of a discharge mode of a pump type product, and of making sharp a content discharge starting operation and a content discharge finishing operation by making the mechanism one where a discharge valve on the side of the discharge outlet is surely changed over from an open state (=discharge mode) up to that time to a closed state (=discharge finish mode) when a content discharge outlet portion is settled in the form of a fixed member not moving even in actuation of an operation part, a pressure storage type is used for the discharge valve, and the operation section moves by a predetermined stroke following a setting operation of the content to the discharge mode.

The content discharge mechanism of the present invention is used as a pump mechanism for various contents described later including nasal spray.

The "pump type" used in the present specification is a system where a volume of a content containing space is reduced by pressing, for example, an operation part of a container (such as a peripheral surface) by a user, and the contents therein are discharged to an external space, the idea including a push-out type and a tube type.

BACKGROUND OF THE INVENTION

There is known a prior art content discharge mechanism as a content discharge mechanism where a discharge outlet of the contents accommodated in a pump type container is provided on another fixing member different from the operation part in Japanese Patent No. 3177695. The following reference numbers with [ ] indicate those in the present reference.

In the '695 patent, a pressure body [15], a sealing body [14], and a large piston [23] are integrated, where once a user pushes down the pressure body, the operation part, the large piston is also moved downward.

Hereby, there is boosted the pressure of chemical in a space [B] between the large piston [23] and an elastic tube [22e] as the suction valve that blocks a transparent hole [22c1] in the small piston [22] relatively movable with respect to the large piston.

As the pressing-down operation of the pressure body [15] is performed several times to permit chemical pressure in the space [B] to rise to a predetermined value, the small piston [22] is pushed down by the pressure, resulting in conical-shaped step part [23c1] etc. a contact part (discharge valve) between both the pistons being separated. Hereby, the chemical in the space [B] is injected to a diseased part from the nozzle hole [16a1] of the nozzle [16] after passage through the separation part, shaft hole [23c], space [D].

The nozzle [16] is fixed to an adapter [13] integral with the container body [11] and so is prevented from moving even upon the pushing-down operation of the pressure body [15].

The content discharge mechanism of the pump type container described above is configured in such a way that the nozzle [16] equipped with the nozzle hole [16a1] is another member independent from the pressure body [15] and the nozzle is prevented from moving downward even upon the operation of the pressure body. This is user-friendly.

In contrast, in addition to the large piston [23] interlocking with the pressure body [15], there is provided the small piston [22] relatively vertically movable with respect to the former, presenting an action of the discharge valve by the contact and separation between these pistons. Further, the transparent hole [22c1] of the small piston [22] and an elastic tube [22e] blocking the transparent hole [22c1] act as the suction valve.

The discharge valve in the discharge mode is closed when the chemical in the space [B] is injected from the nozzle hole [16a1] to permit the pressure of the chemical in the space to be gradually reduced to a threshold or lower, and the operation changes to the discharge finishing mode. More specifically, following the reduction of the chemical pressure in the space the small piston [22] returns upward to close the shaft hole [23c] of the large piston [23], preventing the chemical from being injected.

The foregoing content discharge mechanism suffers from the problem that not only the suction valve but also the discharge valve are formed with the large piston [23] and the small piston [22] provided on the vertical upstream passage i.e. the downstream passage up to the nozzle hole [16a1] extending to the upstream passage does not include the valve member so that the entire structure is complicated and a flow of the chemical is not smooth.

Further, pressure of the chemical in the space [B] in the discharge mode is gradually reduced, so that injection finishing operation of the chemical (transition operation from the discharge mode to the discharge finishing mode) lacks sharpness.

OBJECTS OF THE INVENTION

It is an object of the present invention to make a pump structure simple and make smooth a flow of the contents from the suction valve to the discharge valve by providing the discharge valve for the contents not on the upstream passage formed between the piston and the suction valve interlocking with the operation part but on the downstream passage interlocking with the upstream passage and leading to a fixed type content discharge outlet (not interlocking with the operation part).

It is another object of the present invention to make sharp the operation itself of starting and finishing discharge of the contents by constructing the discharge valve of the downstream passage as a pressure storage type, and by constructing the discharge valve such that it (it has been an open state of the discharge mode by the movement of the operation part up to that time) is instantaneously closed by making use of quick reduction of the content pressure with respect to the discharge valve in the stage where a user moves the operation part by a predetermined stroke.

It is further another object of the present invention to suppress performance deterioration of mechanism itself and a change in properties of the contents accompanying a contact between a metal part, a component of the content discharge mechanism by disposing a first elastic member for energizing the operation part and the piston integral with the former to a stationary mode position and a second elastic member for energizing the discharge valve to a closed state outside the passage for the contents; constructing the suction valve using a synthetic resin; and eliminating a chance where the metal part of the component of the content discharge mechanism and the contents make contact with each other.

SUMMARY OF THE INVENTION

These and other objects are obtained by the content discharge mechanism of the present invention.

(1) Broadly, the present invention is designed as a content discharge mechanism of a pump type container and comprises:

1. an operation part (e.g., operation button 1, 41, operation lever 21 described later), which is an operation object for discharging the contents accommodated in the pump type container from a discharge outlet (e.g., holes 8*b*, 57*a*, 71*a* described later) to external space;

2. a piston (e.g., sheath-shaped piston 2, 22, 42 described later) interlocking with said operation part;

3. a suction valve (e.g., annular reception surface 3*c* and spherical body 5 annular reception surface 27*a* and spherical body 5, annular reception surface 51*c* and spherical body 5, and annular reception surface 81*c* and semi-spherical part 84*c*) actuated in response to the movement of the piston;

4. an upstream side passage (e.g., part of upstream passage A described later) formed between said piston and said suction valve;

5. a downstream passage (e.g., downstream passage B described later) reaching the discharge outlet from a communication part (e.g., hole 3*f*, 23*k*, 31*k*, 44*k*, 51*h*, and 81*g* described later) with the upstream side passage;

6. a discharge valve (e.g., annular edge part 8*b* and annular tapered surface 9*a*, annular edge part 24*a* and annular tapered surface 9*a*, annular edge part 32*a* and annular tapered surface 9*a*, annular edge part 46*a* and annular tapered surface 47*a*, tip end side valve action part 58*a*, 72*a*, annular edge part 82*a* and annular tapered surface 83*a*, and annular protruded part 82*b* and intermediate outer circumferential surface 83*b*) provided on said downstream side passage; and 7. a discharge outlet setting member (e.g., lateral nozzle 3*e*, lateral nozzle member 24, 56, 82, longitudinal nozzle member 32, 45 described later) integrated with an opening part cap (e.g., screw cap 3, 23, 31, 44, 51, 81 described later) of the container for setting the discharge outlet in the state where it does not move even at the time of the actuation of the operation part.

(2). In (1), the discharge valve is a pressure storage type one.

(3). In (1) and (2), the piston (e.g., sheath-shaped piston 2, 22, 42 described later) is provided in a cylinder (e.g., inside cylindrical part 3*a*, 51*a*, 81*a*, rear side lateral cylindrical part 23*b*, intermediate sheath-shaped part 32*b*, 44*b*) including in its peripheral surface part a transition hole (e.g., hole 3*f*, 51*h*, 81*g*, 23*d*, 31*d*, 44*d* described later) from a discharge mode, where said discharge valve is opened to a discharge finishing mode where the discharge valve returns to a closed state and a seal action part (e.g., sealing action part 2*b*, 22*b*, 42*b* described later) of the piston advances together with the operation part from its stationary mode position via discharge mode position to the hole whereby the downstream side passage is also communicated with a space region (e.g., passage outside space region E described later) other than the upstream side passage to reduce the pressure of the contents acting to the discharge valve, resulting in the operation being transferred from the discharge mode till then to the discharge finishing mode.

(4). In (3), the transition hole is a communication hole (e.g., hole 3*f*, 51*h*, 81*g* described later) located between the upstream passage and the downstream passage.

(5). In (3), the transition hole is a communication hole (e.g., hole 23*d*, 31*d*, and 44*d* described later) located between the cylinder (e.g., rear side lateral cylindrical part 23*b*, and intermediate sheath-shaped part 32*b* and 44*b* described later) and a suction valve side space region e.g., longitudinal cylindrical part 23*a*, lower longitudinal cylindrical part 31*a*, 44*a* described later) provided upstream thereof (6). In (1) to (5), the upstream passage comprises a space region corresponding to a longitudinal direction of a container body (e.g., container body 12 described later) and the downstream passage comprises corresponding to a lateral direction of a container body.

(7). In (1) to (5), the upstream passage and the downstream passage comprise a space region corresponding to a longitudinal direction of a container body.

(8). In (1) to (7), a first elastic member (e.g., coil spring 43, 53 described later) for energizing the piston to a stationary mode position and a second elastic member (e.g., coil spring 48, 59 described later) for energizing the discharge valve to a closed state are disposed outside the upstream passage and the downstream passage (9) In (1) to (8), the suction valve consists of a movable valve part (e.g., semispherical part 84*c* described later) equipped with an elastic member entirely made of a synthetic resin for energizing the suction valve to a closed state.

A pump type product equipped with the content discharge mechanism described above and accommodating the contents are objects of the present invention.

EFFECT OF THE INVENTION

In accordance with the present invention, the discharge valve of a pump type product is provided on the downstream passage communicated with the upstream passage to extend to the fixed type content discharge outlet, not on the upstream passage located between the suction valve and the piston interlocking with the operation part, so that the content discharge outlet is maintained at the stationary mode position before the operation even when the operation part is moved upon setting operation to the discharge mode, resulting in a convenient mechanism making the pump mechanism itself simple for a smooth flow of the contents therein.

The mechanism is configured such that the discharge valve of the downstream passage is made a pressure storage type, and when the operation part is moved by a predetermined stroke i.e. a sealing action part off the piston for specifying the upstream passage advances to a facing position of the communication hole (between the upstream passage and the downstream passage) while abutting a cylinder inner peripheral surface, a cylinder space region separated from the content passage up to just before is communicated with the upstream passage and the downstream passage after passage through the hole to permit the pressure of the contents to the discharge valve to be abruptly reduced, so that opening and closing operation of the discharge valve, so that the opening and closing operation of the discharge valve are made quick, ensuring the "sharpness" of each operation at the time of starting or finishing of the discharge of the contents of the discharge valve.

The first elastic member for energizing the operation part and the piston integral therewith to the stationary mode position and the second elastic member for energizing the discharge valve to a closed state are disposed outside the passage of the contents, and the suction valve is made of a synthetic resin and there is no chance of the metal part of the component of the content discharge mechanism making contact with the contents, so that it is possible to suppress a change in properties of the contents following the contact and performance deterioration of the mechanism itself.

BRIEF DESCRIPTION OF THE DRAWINGS

These and other aspects of the present invention may be more fully understood by reference to one or more of the following drawings.

DESCRIPTION OF REFERENCE CHARACTERS

The following constituent components indicated by reference numbers each with an alphabet (e.g., skirt part 2*a*) denote parts of those without alphabet (e.g., sheath-shaped piston 2).

Although reference numbers in the description below are brought together for every figure of each embodiment of the content discharge mechanism, a reference number appearing in a certain figure (e.g., FIGS. 1 to 3) is used at need as an index indicating the same kind as a constituent element of the aforementioned reference number even in other figures (e.g., FIGS. 4 to 11).

Figure 1:
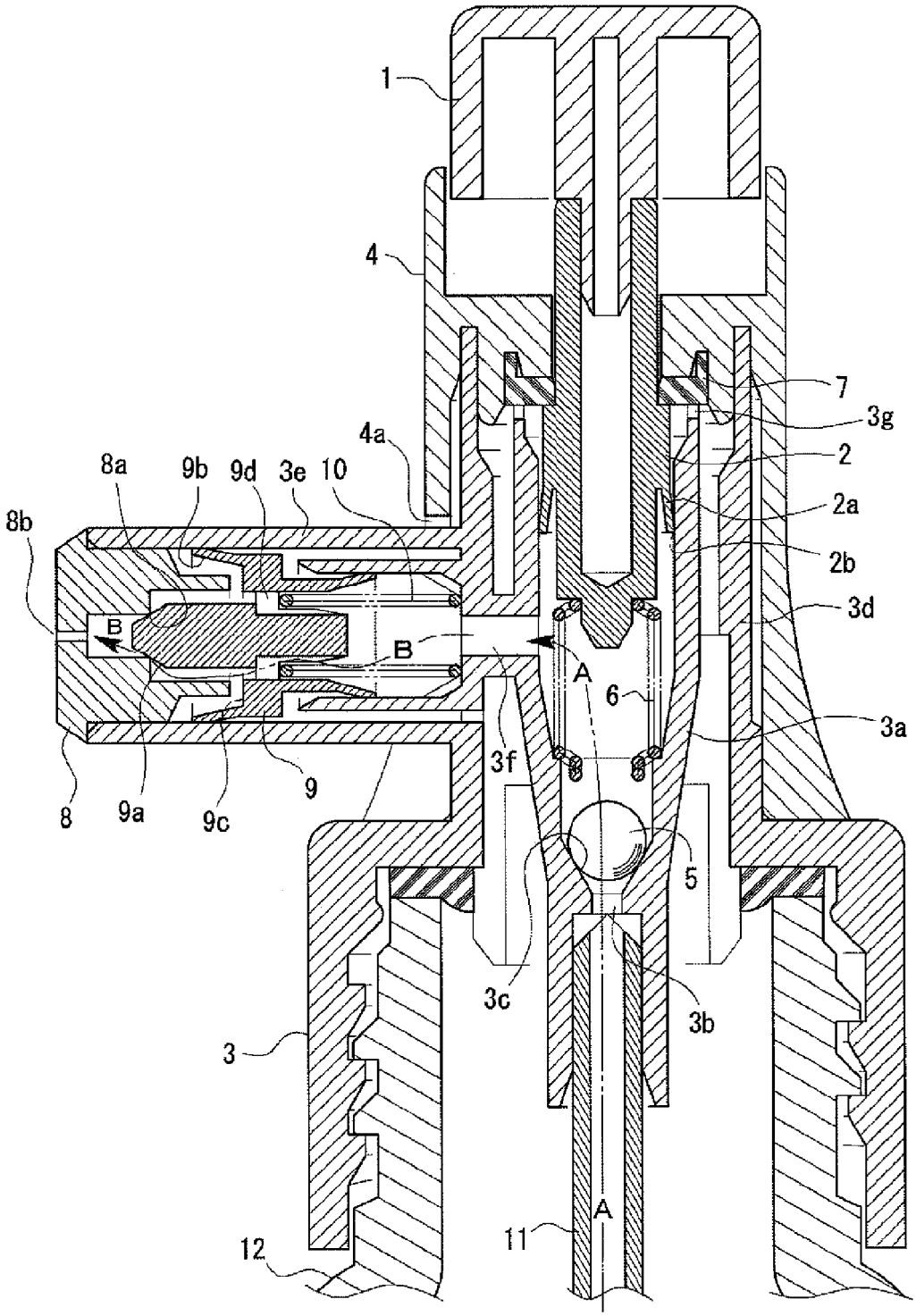
FIG. 1 is a view illustrating the stationary mode of the content discharge mechanism (first 1: longitudinal upstream passage, lateral passage, and longitudinal push button type) (Embodiment 1)
Figure 2:
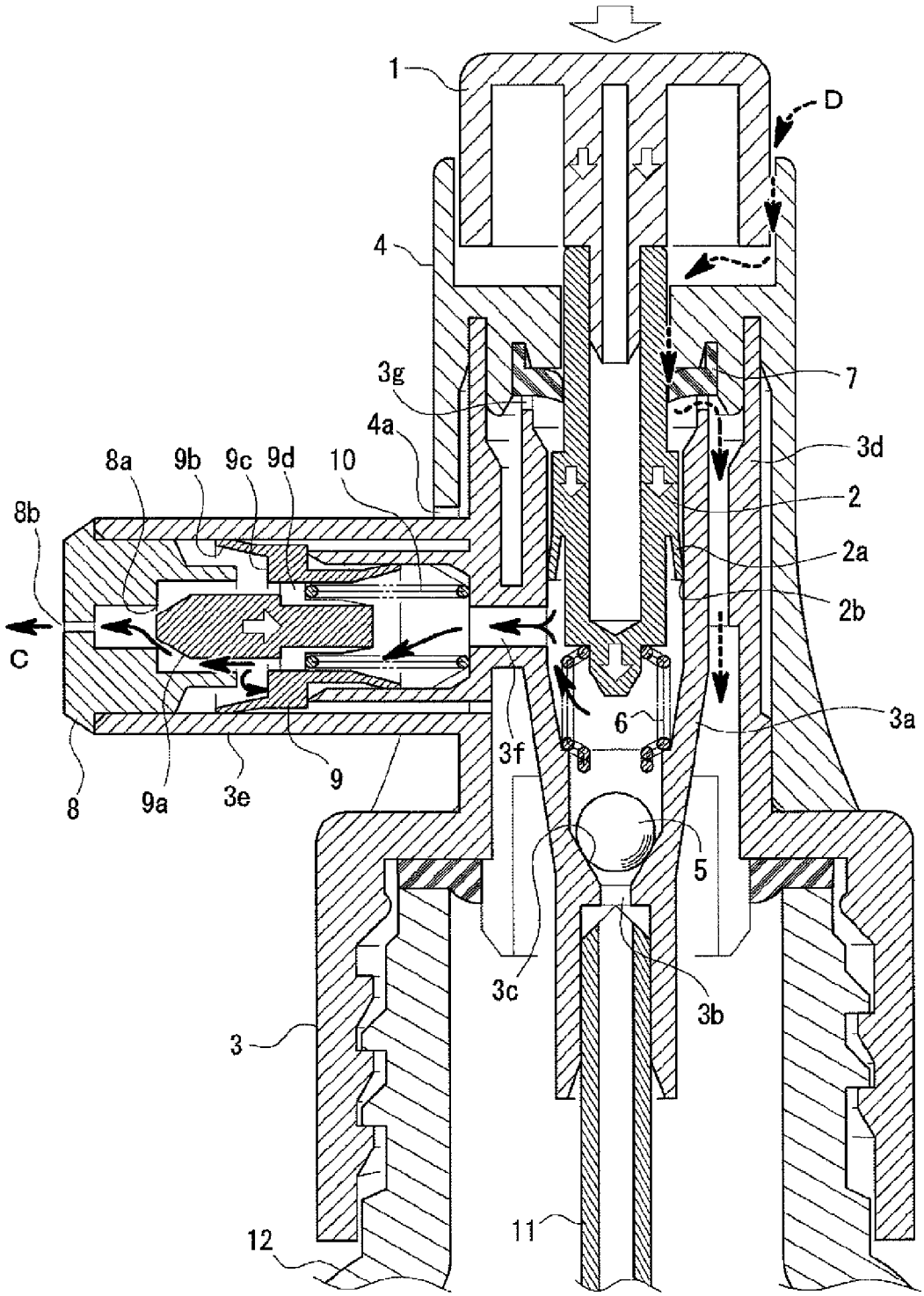
FIG. 2 is a view illustrating the discharge mode of the content discharge mechanism of FIG. 1 (Embodiment 1)
Figure 3:
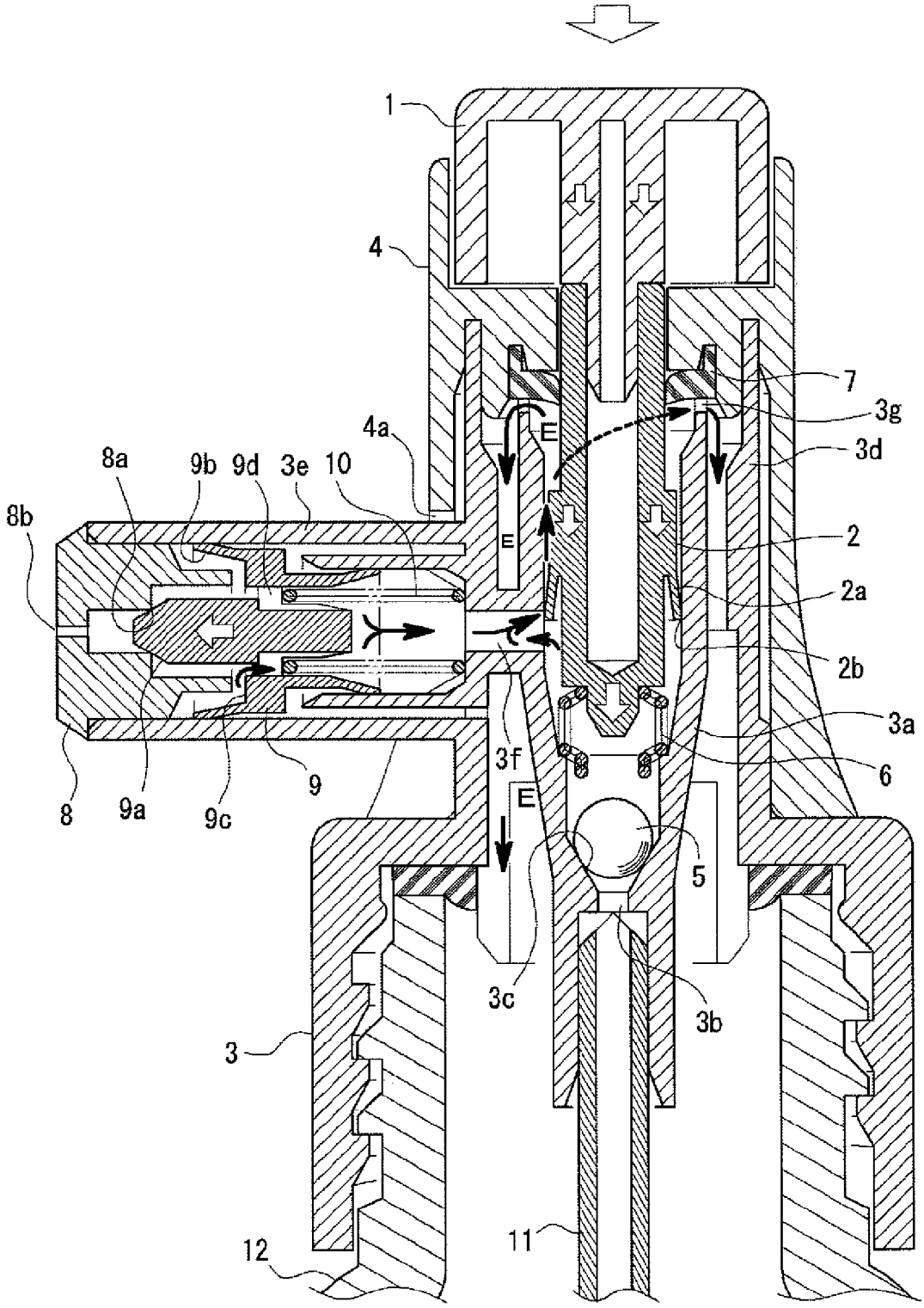
FIG. 3 is a view illustrating the discharge finishing mode of the content discharge mechanism of FIG. 1 (Embodiment 1)

In FIGS. 1 to 3, designated at

1 is an operation button;

2 a sheath-shaped piston fitted to and integrated with the operation button 1;

2*a* a skirt part presenting sealing action making contact with an inner peripheral surface of an inside cylindrical part 3*a* described later;

2*b* a sealing action part on the side of a tip end of the skirt part;

3 a screw cap threadably mounted on an opening side cylinder part of a container body 12 of a pump type product described later;

3*a* a longitudinal inside cylindrical part for accommodating the sheath-shaped piston 2 and a spherical body to settle (part of) the upstream passage A;

3*b*: a hole for content inflow formed below the inside cylindrical part itself;

3*c* an annular reception surface formed on the downstream side abutting on the hole and constituting the suction valve together with the spherical body 5 described later;

3*d* a longitudinal outer annular part connected circumferentially partly of an outer peripheral surface of the inside cylindrical part 3*a;*

3*e* a lateral nozzle for setting a downstream passage B abutting on the upstream passage A;

3*f* a hole for communication of the upstream passage A and the downstream passage B;

3*g* a recessed missing part intermittently formed circumferentially of an upper end part of the inside cylindrical part 3*a*, through which fresh air (refer to FIG. 2) and the contents pass;

4 a cylindrical cover fitted to the outside upper cylindrical part 3*d* of the screw cap 3 and including guide function for the operation button 1 and vertical motion of the sheath-shaped piston 2;

4*a* a circumferential surface opening part for avoiding collision with the nozzle 3*e* when mounting the cover on the screw cap 3;

5 a spherical body disposed so as to make close contact with the annular reception surface 3*c* to construct the suction valve;

6 a coil spring disposed between a bottom surface step part of the sheath-shaped piston 2 and the inner circumferential surface step part of the inside cylindrical part 3*a* for energizing the sheath-shaped piston upward;

7 a sealing annular rubber held between the inside cylindrical part 3*a* and the cover body 4 and making contact with the outer circumferential surface of the sheath-shaped piston 2;

8 an output side piece fitted to and integrated with an opening side of the nozzle 3*e;*

8*a* an annular edge part constructing a pressure storage type discharge valve together with an annular tapered surface 9*a* of a piston 9 described later which is an inner surface part of the output side piece;

8*b* a hole for outputting the contents;

9 the piston disposed in the nozzle 3*e* (and lateral nozzle member 24 of FIG. 4 and longitudinal nozzle member 32 of FIG. 5) and having a pressure storage type discharge valve function;

9*a* an annular tapered surface constituting the pressure storage type discharge valve;

9*b* a skirt part abutting on the inner circumferential surface of the nozzle 3*e* located on the side of the hole 8*b* (left side in the figure);

9*c* an annular flat surface, a part on a base side of the skirt part for receiving content pressure in the opposite direction (right direction in the figure) to a direction of energization by a coil spring 10 described later;

9*d* holes for passage of the contents formed intermittently circumferentially of the annular groove part for receiving a coil spring described later;

10 a coil spring for energizing the piston 9 in a direction approaching the hole 8*b* (left direction in the figure);

11 a tube for sucking the contents mounted on a lower end side of the inside cylindrical part 3*a* of the screw cap 3;

12 a container body containing nose drops etc.;

A an upstream passage extending from the tube 11 via the hole 3*b* for content inflow (and suction valve) to the sheath-shaped piston 2 and the hole 3*f* for communication;

B a downstream passage extending from the hole 3*f* for communication to the hole 8*b* for outputting the contents;

C a flow of the contents in the discharge mode;

D a flow of fresh air supplied into the container body in the discharge mode where the button 1 is depressed;

E a passage outside space region specified by the sheath-shaped piston 2, the inside cylindrical part 3*a*/outside upper cylindrical part 3*d* of the screw cap 3, the cover body 4, and the annular rubber 7 and communicated to the container body.

Figure 4:
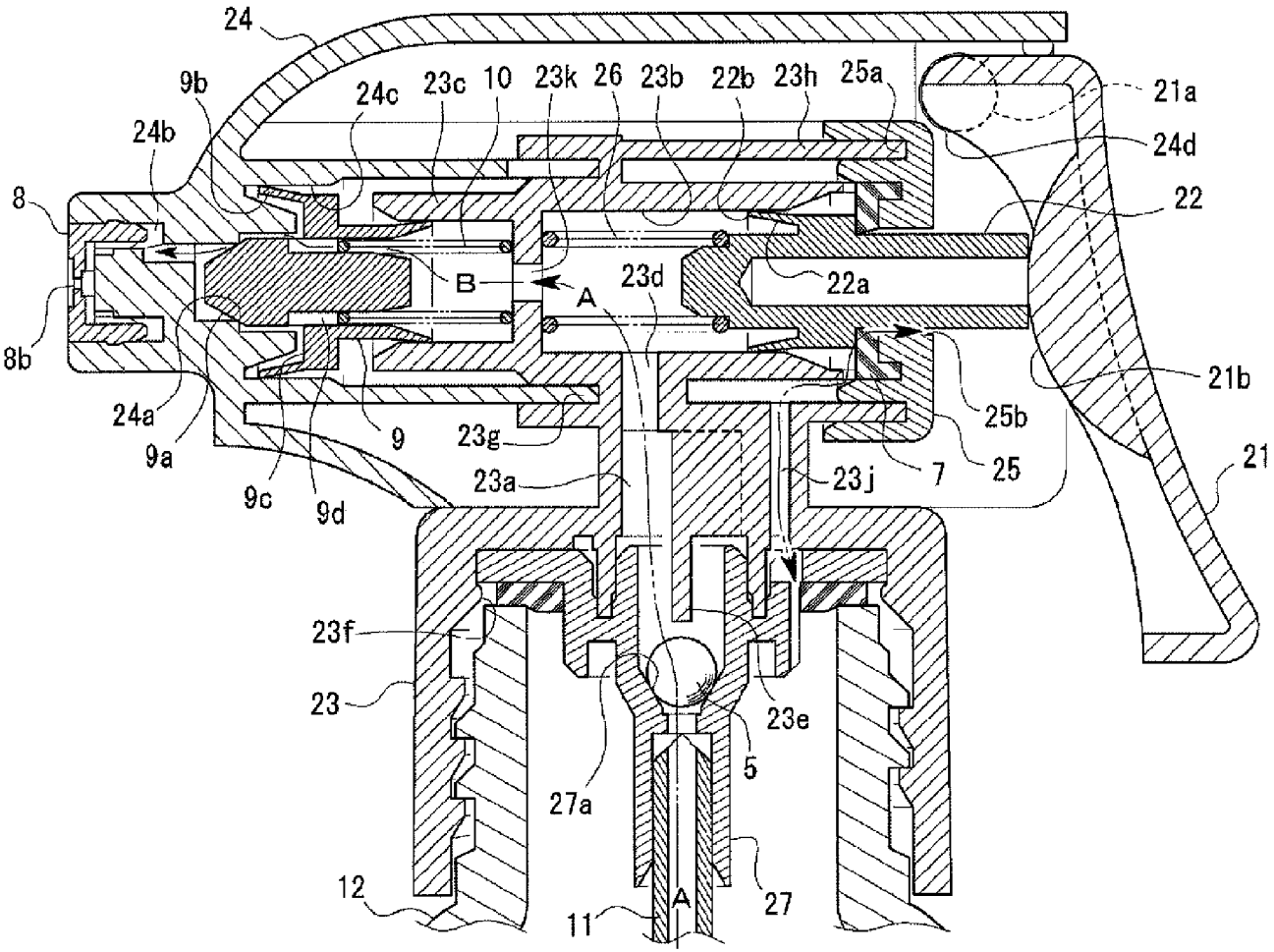
FIG. 4 is a view illustrating the stationary mode of the content discharge mechanism (second one: longitudinal upstream passage, lateral downstream passage, and trigger lever type) (Embodiment 2)

For reference numbers 21 to 27 used anew in FIG. 4, designated at

21 is an operation lever of a rotary type (trigger5 lever);

21*a* a rotary shaft;

21*b* a rib-shaped part formed on the inner surface and abutting on a sheath-shaped piston 22 described later;

22 the sheath-shaped piston where its rear end part abuts on a bowl-shaped part 21*b;*

22*a* a skirt part presenting sealing action while abutting on an inner circumferential surface of a rear side lateral cylindrical part 23*b;*

22*b* a sealing action part of the skirt part on a tip end side;

23 a screw cap threadably engaged with the opening side cylindrical part of the container body 12, on which a lateral nozzle member 24 described later is mounted;

23*a* a longitudinal cylindrical part for setting the upstream passage A (part thereof)

23*b* a rear side lateral cylindrical part, a part abutting on the longitudinal cylindrical part, for accommodating the skirt part 22*a* of the sheath-shaped piston 22 and a coil spring described later etc. to set the upstream passage A (part thereof);

23*c* a front side lateral cylindrical part, part abutting on the left (in the figure) of the rear side lateral cylindrical part, for accommodating the skirt part on the left side (in the figure) of the piston 9 and the coil spring 10 etc. to set the downstream passage B (part thereof);

23*d* a hole (refer to FIG. 3) having a function of making inner space regions of the longitudinal cylindrical part 23*a* and the rear side lateral cylindrical part 23*b* to communicate and a function of releasing a sealed state between the sealing action part 22*b* (part thereof) of the sheath-shaped piston 22 and the lateral cylindrical part in the discharge finishing mode;

23*e* a restriction piece for restricting a movement amount extending downward from a lower side ceiling part of the longitudinal cylindrical part 23*a* and extending upward of the spherical body 5;

23*f* an annular protruded part formed on the upper side of the cap inner circumferential surface and holding a housing 27 described later by engagement;

23*g* an annular recessed part on an upper front side for fitting and holding a lateral nozzle member 24 described later;

23*h* an outer annular part on an upper part rear end side for fitting and holding a reception side piece 25 described later;

23*j* a passage region (refer to D in FIG. 2) for fresh air supplied into the container body in the discharge mode;

23*k* a hole for communication between the upstream passage A and the downstream passage B;

24 a lateral nozzle member held by the annular recessed part 23*g* etc. of the screw cap 23 as a mounting base of the operation lever 21 and having a guide function for longitudinal movement of the piston 9 and a discharge valve function between it and the piston;

24*a* an annular edge part for presenting the same action as the annular edge part 8*a* between it and the piston 9;

24*b* an output space region to which the output side piece 8 is attached as a content passage to an external space from the annular edge part 24*a;*

24*c* an inside cylindrical part presenting sealing action with the skirt part 9*b* of the piston 9 on its inner circumferential surface and thereafter permitting its rear end side part to be held in the annular recessed part 23*g;*

24*d* a pair of recessed parts formed on a side plate inner surface part to support the rotary shaft 21*a* of the operation lever 21;

25 a reception side piece fitted to and held by an outer annular part 23*h* of the screw cap 23 in the state where the annular rubber 7 and the sheath-shaped piston 22 are received;

25*a* an annular recessed part for fitting and holding corresponding to the outer annular part 23*h;*

25*b* a center hole for guiding longitudinal movement of a rear side small diameter part of the sheath-shaped piston 22;

26 a coil spring for energizing the sheath-shaped piston 22 rearwardly;

27 a housing engaged with and held by the annular protruded part 23*f* of the screw cap 23 to construct the suction valve together with the spherical body 5, and including a mounting part for the tube 11; and

27*a* an annular reception surface constructing the suction valve together with the spherical body 5.

Figure 5:
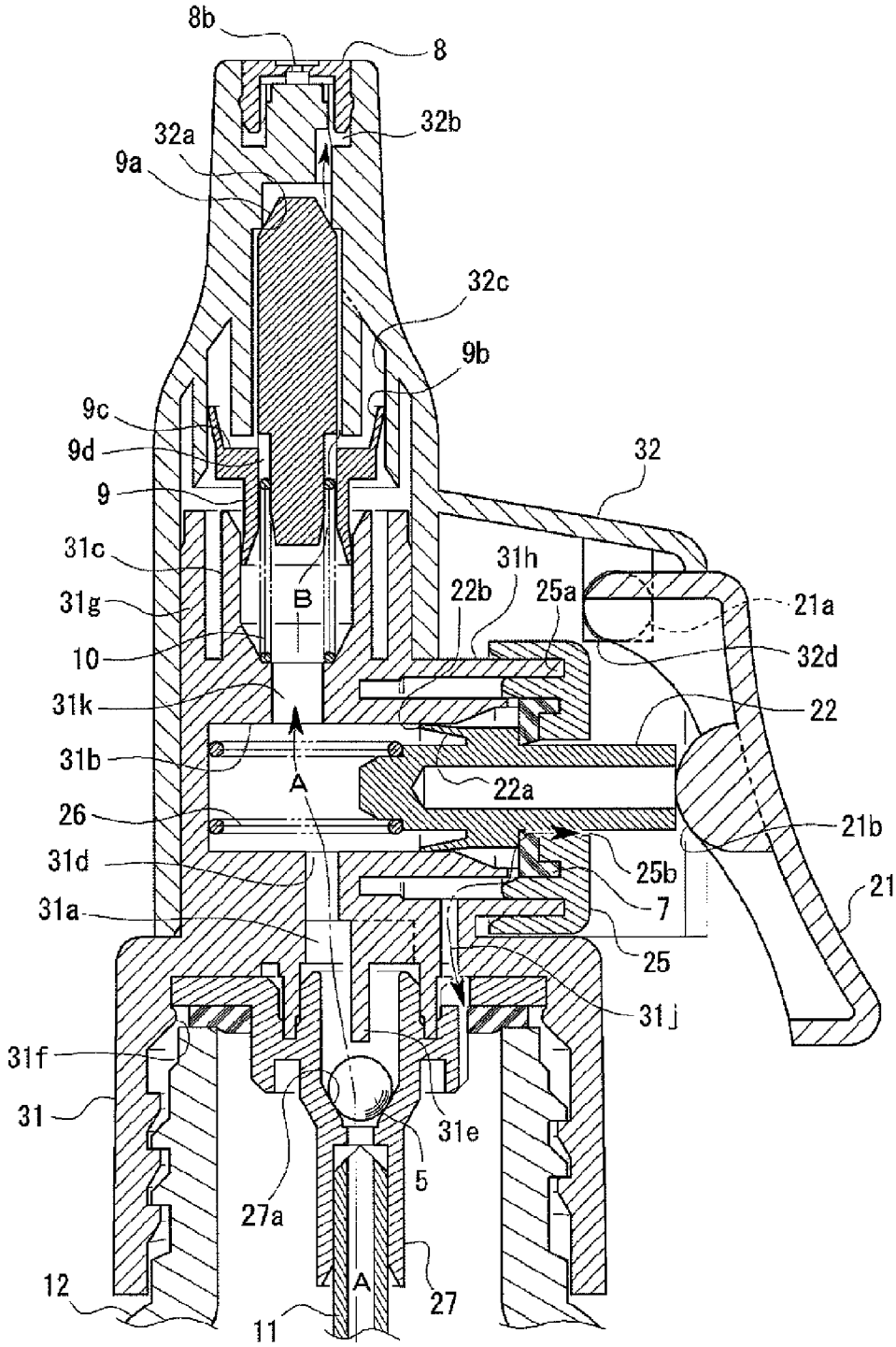
FIG. 5 is a view illustrating the stationary mode of the content discharge mechanism (third one: longitudinal upstream passage, lateral downstream passage, and trigger lever type) (Embodiment 3)

For reference numbers 31, 32 used anew in FIG. 5 designated at

31 is a screw cap threadably engaged with the opening side cylindrical part of the container body 12 to permit a longitudinal nozzle member 32 described later to be mounted thereon;

31*a* a lower longitudinal cylindrical part for presenting the same action as the longitudinal cylindrical part 23*a;*

31*b* an intermediate sheath-shaped part for presenting the same action as the rear side lateral cylindrical part 23*b;*

31*c* an upper longitudinal cylindrical part, part abutting on an upper portion of the lateral sheath-shaped part, for accommodating the skirt part on a lower side of the piston 9 and the coil spring etc. (energized upward with elastic action of the coil spring 10 and moving downward resisting the energizing force based on an increase of content pressure upon setting operation of the actuation mode) to set the downstream passage B (part thereof);

31*d* a hole (refer to FIG. 3) having a function of making inner space regions of the lower longitudinal cylindrical part 31*a* and the intermediate sheath-shaped part 31*b* communicate, and releasing a sealing state between the sealing action part 22*b* (part thereof) of the sheath-shaped piston 22 and the intermediate sheath-shaped part and changing the discharge mode up to that time to a discharge finishing mode;

31*e* a restriction piece for presenting the same action as the annular protruded part 23*f;*

31*f* an annular protruded part for presenting the same action as the annular protruded part 23*f;*

31*g* a longitudinal outer annular part for holding by fitting a longitudinal nozzle member described later;

31*h* a lateral annular part for presenting the same action as the outer annular part 23*h;*

31*j* a passage region for fresh air supplied into the container body in the discharge mode (refer to D in FIG. 2);

31*k* a hole for communication between the upstream passage A and the downstream passage B;

32 a longitudinal nozzle member, held by a longitudinal outer annular part 31*g* of the screw cap as a mounting base part of the operation lever 21 and having a guide function for longitudinal movement of the piston 9 and a discharge valve function between it and the piston;

32*a* an annular edge part for presenting the same action as the output space region 24*b;*

32*b* an output space region for presenting the same action as the output space region 24*b;*

32*c* an inside longitudinal annular part for presenting the sealing action between it and the skirt part 9*b* of the piston 9 on its inner circumferential surface; and

32*d* a pair of recessed parts for presenting the same action as the recessed part 24*d.*

Figure 6:
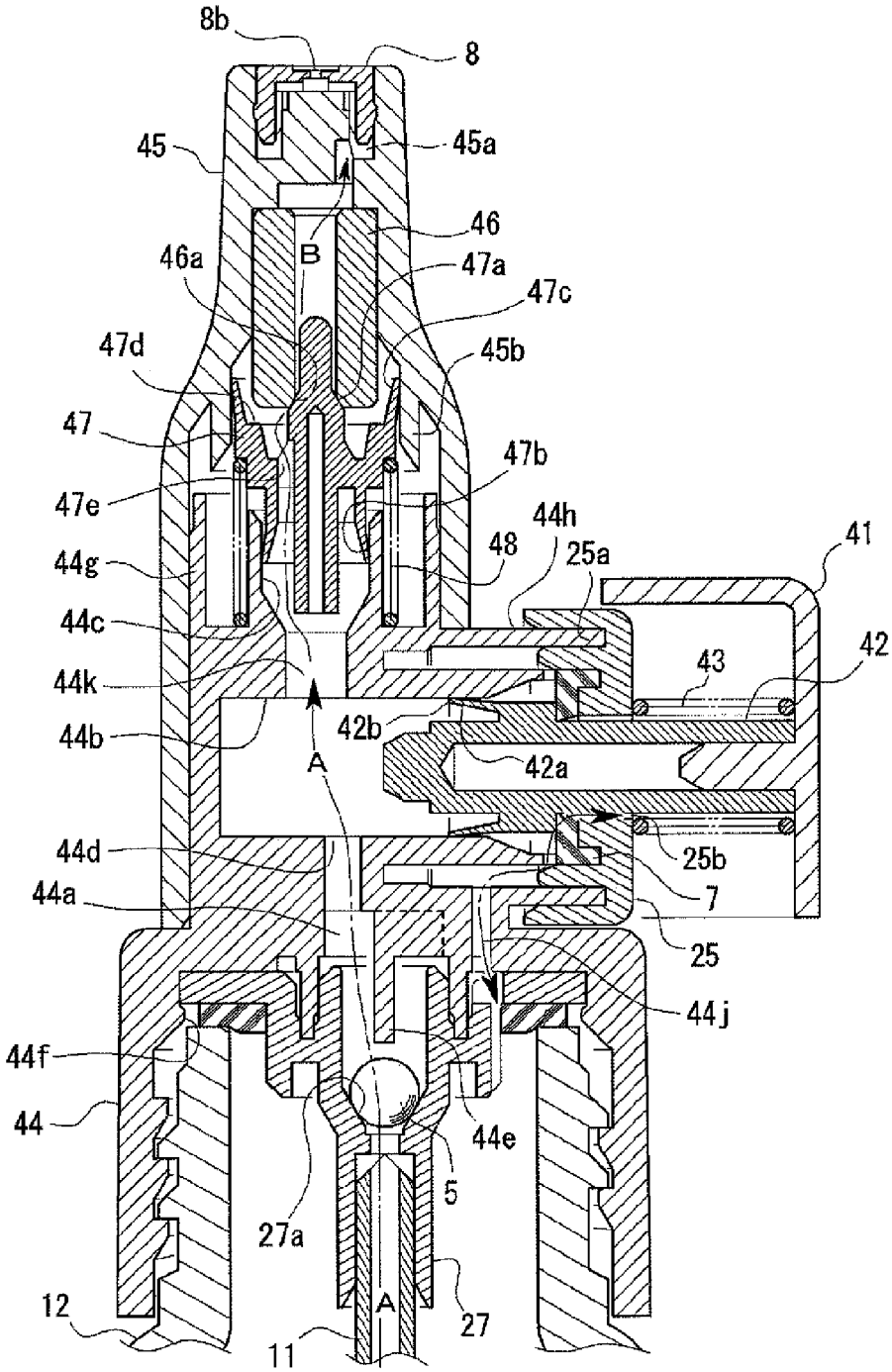
FIG. 6 is a view illustrating the stationary mode of the content discharge mechanism (fourth one: longitudinal upstream passage, longitudinal downstream passage, lateral push button type, and coil springless of the passage (Embodiment 4)

For reference numbers 41 to 48 used anew in FIG. 6, designated at

41 is a push type operation button moving laterally while guided to an upper surface part of 25;

42 a sheath-shaped piston fitted to the operation button 41;

42*a* a skirt part for presenting the same action as the skirt part 22*a* in FIG. 5;

42*b* a sealing action part for presenting the same action as the sealing action part 22*b* in FIG. 5;

43 a coil spring wound on a protruded outer circumferential surface part of the sheath-shaped piston 42 for energizing the operation button 41 in the right direction in the figure;

44 a screw cap threadably mounted on an opening side cylindrical part of the container body 12, on which a longitudinal nozzle member 45 described later is mounted;

44*a* a lower longitudinal cylindrical part for presenting the same action as the lower longitudinal cylindrical part 31*a;*

44*b* an intermediate sheath-shaped part where the coil spring 26 is removed from the intermediate sheath-shaped part 31*b* in FIG. 5

44*c* an upper longitudinal cylindrical part where the coil spring 10 is removed from the upper longitudinal cylindrical part 31*c* in FIG. 5;

44*d* a hole (refer to FIG. 3) having a function of making inner space regions of the lower longitudinal cylindrical part 44*a* and the rear side lateral cylindrical part 44*b* communicate, and a function of releasing a sealing state between the sealing action part 42*b* (part thereof) of the sheath-shaped piston 42 and the lateral cylindrical part in the discharge finishing mode;

44*e* a restriction piece for presenting the same action as the restriction piece 23*e;*

44*f* an annular protruded part for presenting the same action as the annular protruded part 23*f;*

44*g* a longitudinal outer annular part for holding by fitting a longitudinal nozzle member 45 described later;

44*h* a lateral outer annular part for presenting the same action as the outer annular part 23*h;*

44*j* a passage region for fresh air (refer to D in FIG. 2) supplied into the container body in the discharge mode;

44*k* a hole for communication between the upstream passage A and the downstream passage B;

45 a longitudinal nozzle member for presenting the same action as the longitudinal nozzle member 32;

45*a* an output space region for presenting the same action as the output space region 32*b;*

45*b* an inside longitudinal annular part for presenting the sealing action between it and the upper skirt part 47*c* of a piston 47 described later on its inner circumferential surface;

46 a cylindrical body held by fitting on a front side of the output space region 45*a* of the longitudinal nozzle member 45 for presenting the action of a pressure storage type discharge valve;

46*a* an annular edge part constituting the discharge valve together with an annular tapered surface 47*a* of a piston 47 described later;

47 a piston disposed in the longitudinal nozzle member 45 and having a pressure storage type discharge valve function;

47*a* an annular tapered surface constituting the discharge valve together with the annular edge part 46*a;*

47*b* a lower skirt part abutting on the inner circumferential surface of the longitudinal annular part 45*b* of the longitudinal nozzle member 45 to present the sealing action;

47*c* an upper skirt part abutting on the inner circumferential surface of the longitudinal annular part 45*b* of the longitudinal nozzle member 45 to present the sealing action;

47*d* a horizontal annular flat surface, part located on a base part of the skirt part for receiving downward content pressure;

47*e* a hole for passage of the contents formed intermittently circumferentially of the inside annular groove part of the upper skirt part; and

48 a coil spring disposed between a bottom surface of an annular groove part between the longitudinal outer annular part 44*g* of the screw cap 44 and an outer circumferential surface of the upper longitudinal cylindrical part 44*c* and an outer circumferential surface side step part of the upper skirt part 47*c* of the piston 47 for energizing the piston upward.

Figure 7:
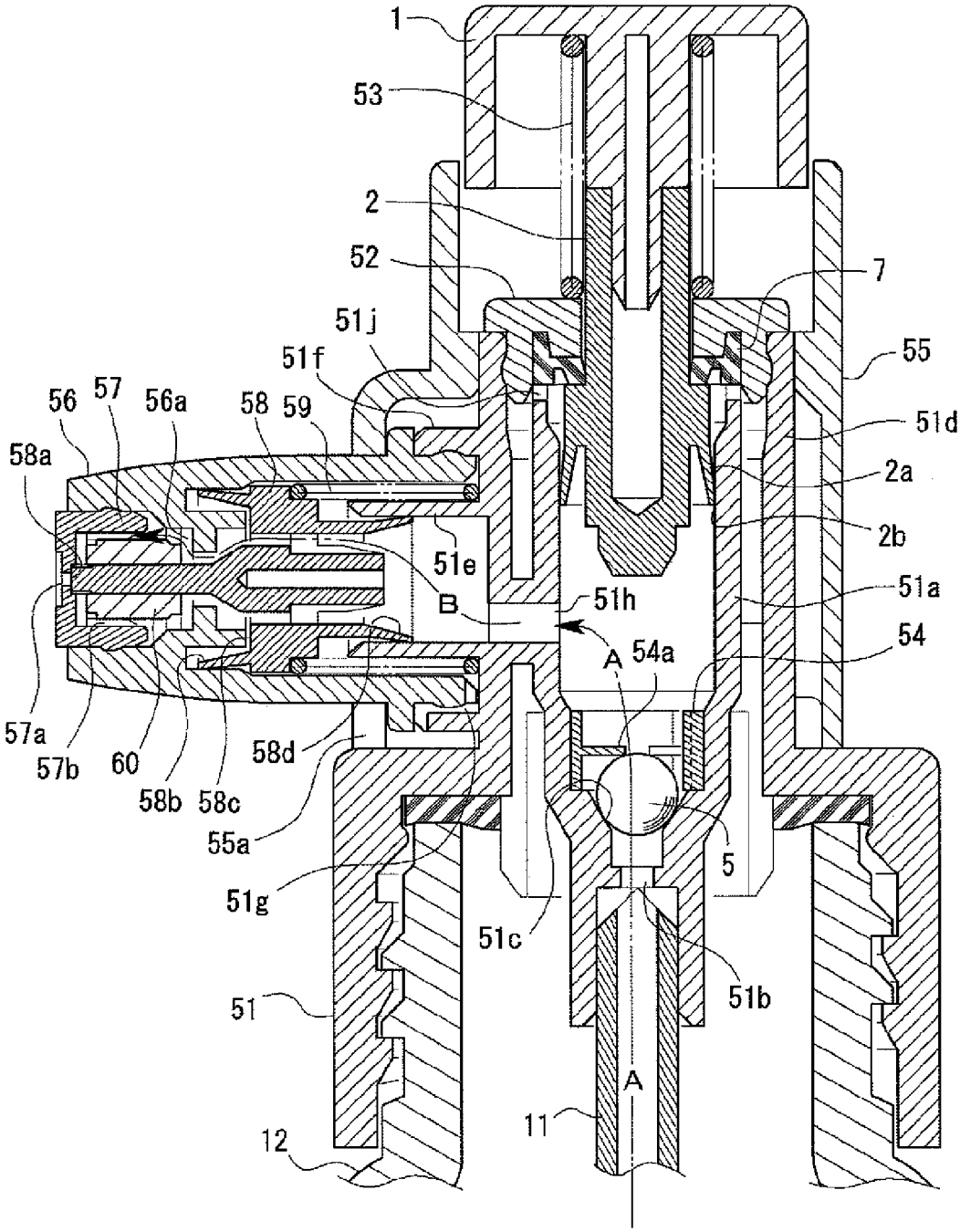
FIG. 7 is a view illustrating the stationary mode of the content discharge mechanism (fifth one: longitudinal upstream passage, lateral downstream passage, longitudinal push button type, tip sealing function, and coil springless of the passage) (Embodiment 6)
Figure 8:
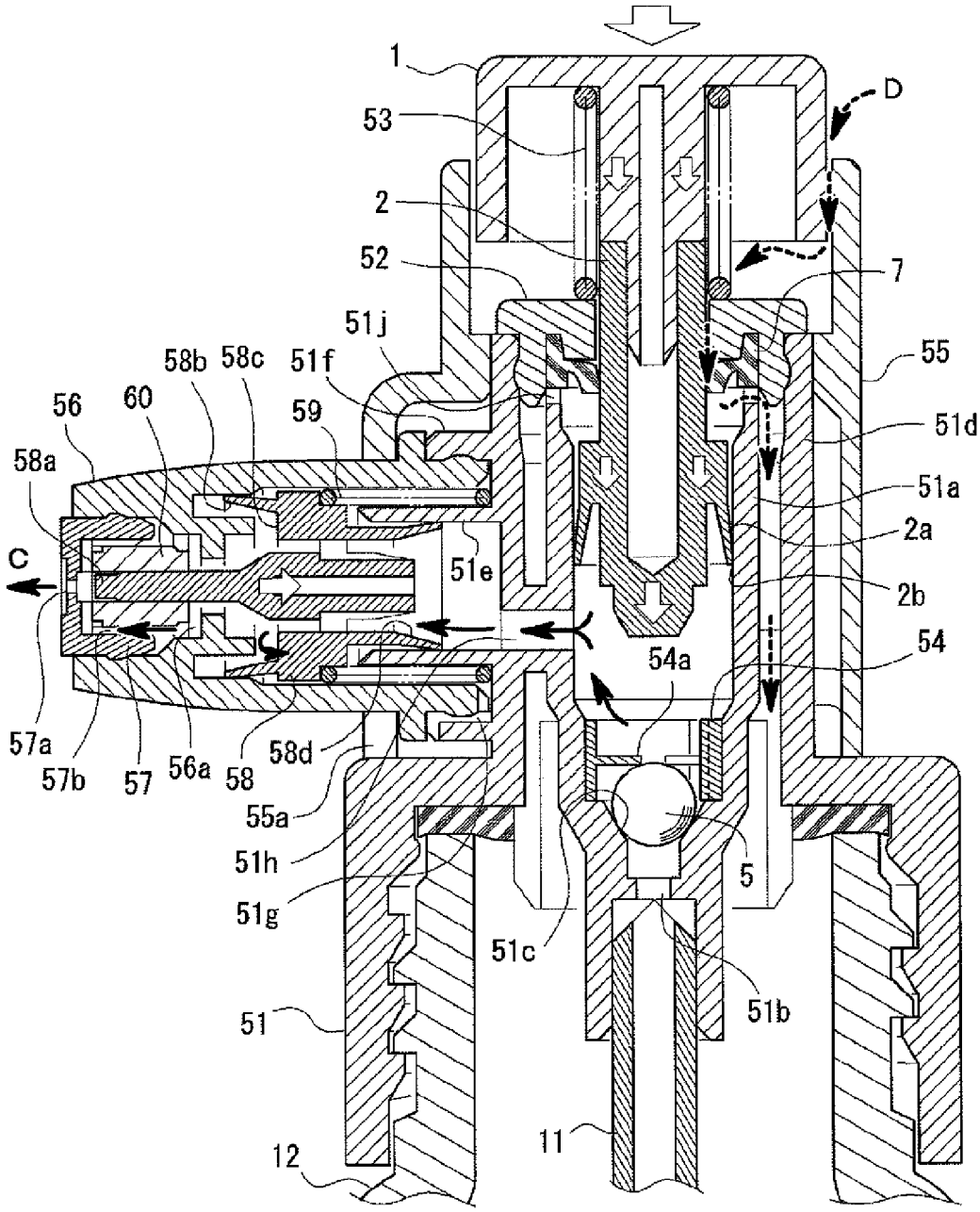
FIG. 8 is a view illustrating the discharge mode of the content discharge mechanism of FIG. 7 (Embodiment 6)
Figure 9:
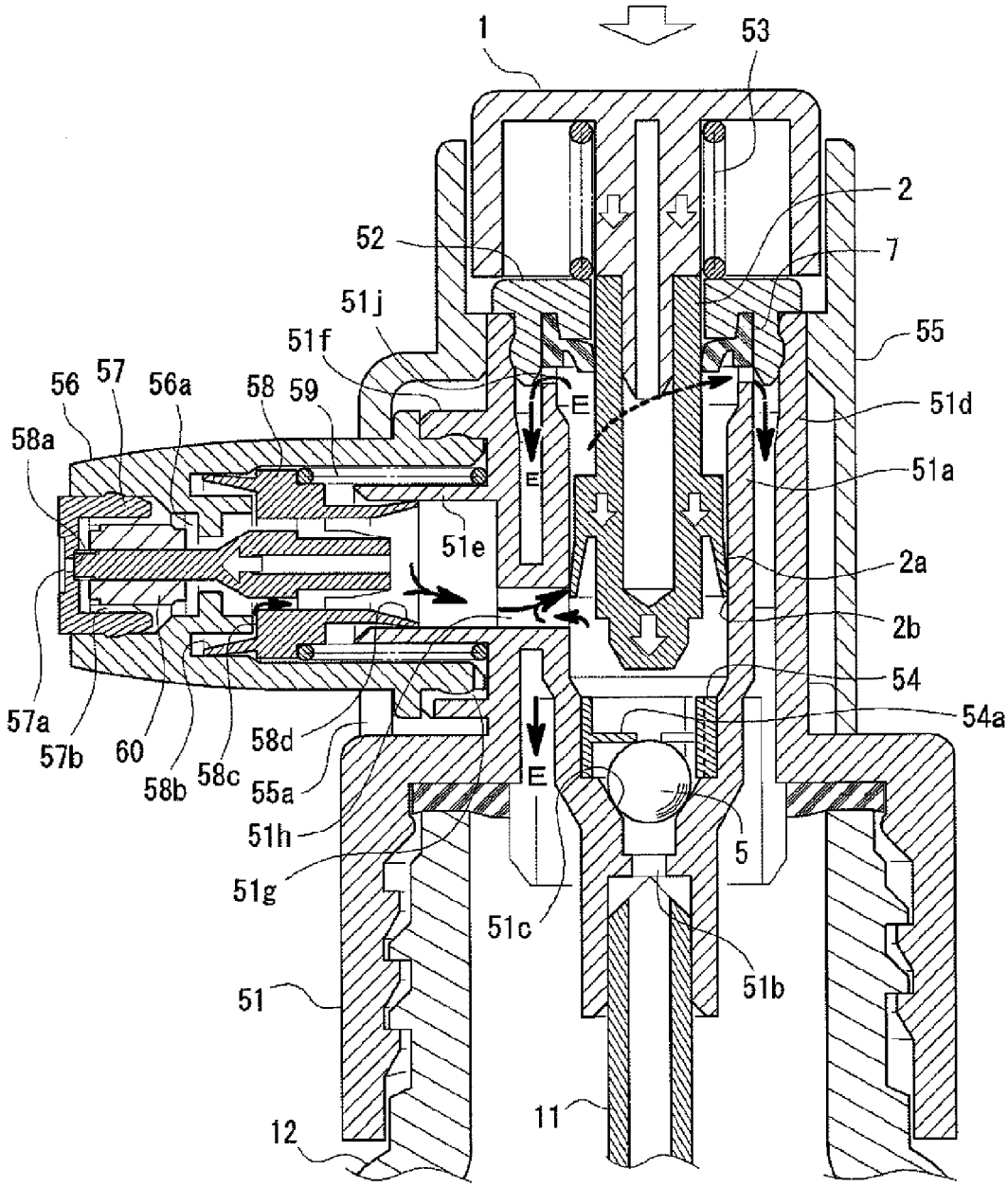
FIG. 9 is a view illustrating the discharge finishing mode of the content discharge mechanism of FIG. 7 (Embodiment 6)

Reference numbers 51 to 60 used anew in FIGS. 7 to 9 designated at

51 is a screw cap threadably mounted to the opening side cylindrical part of the container body 12;

51*a* a longitudinal inside cylindrical part for presenting the same action as the inside cylindrical part 3*a;*

51*b* a hole for content inflow for presenting the same action as the hole 3*b;*

51*c* an annular reception surface for constructing the suction valve for presenting the same action as the annular reception surface 3*c;*

51*d* a longitudinal outer annular part connected with an outer circumferential surface of the inside cylindrical part 51*a* and partly with its circumferential direction;

51*e* a lateral cylindrical part constituting part of the downstream passage B;

51*f* a lateral outer annular part formed around the cylindrical part;

51*g* a groove shaped part for fresh air communication formed from a right end part of the outer annular part to an outer circumferential surface of the same;

51*h* a hole for communication between the upstream passage A and the downstream passage B;

51*j* a recessed missing part formed intermittently circumferentially of an upper end of the upstream passage A, through which fresh air (refer to FIG. 8) and the contents (refer to FIG. 9) pass;

52 a reception side piece fitted to and held by the outer annular part 51*k* of the screw cap 51 while receiving the annular rubber 71 sheath-shaped piston 22, and a coil spring 53 described later etc.;

53 a coil spring disposed between the reception side piece and the operation button 1 for energizing upward the operation button;

54 a spherical body press member held (fitted) by an inner circumferential surface lower part of the inside cylindrical part 51*a* of the screw cap 51;

54*a* a plurality of elastically deformable ribs for pressing the spherical body 5 downward;

55 a cover including an opening region to a lateral nozzle member 56 described later and fitted to and held by the screw cap 51;

55*a* a circumferential surface opening part for avoiding the collision against a lateral nozzle member 56 described later upon mounting the cover on the screw cap 51;

56 a lateral nozzle member fitted to the lateral outer annular part 51*f* of the screw cap 51;

56*a* a protruded part formed intermittently circumferentially of an inner circumferential surface on an opening part side;

57 an output side piece fitted to and integrated with the opening side of the lateral nozzle member 56;

57*a* a hole for outputting the contents;

57*b* a rib-shaped part formed intermittently circumferentially of the inner circumferential surface for holding a cylindrical member 60 described later;

58 a pressure storage type piston disposed in an internal space region of the lateral nozzle member 56 and having a chip sealing function to the hole 57*a;*

58*a* a tip end side valve action part for closing the hole 57*a* of the output side piece 57 in the stationary mode shown in the figure;

58*b* a skirt part on the left side in the figure abutting on the internal circumferential surface of the lateral nozzle member 56 for presenting sealing action;

58*c* a vertical annular flat surface, part of the left side skirt part on a base part side for receiving content pressure to the right direction in the figure;

58*d* a skirt part on the right side in the figure abutting on the internal circumferential surface of the cylindrical part 51*e* in a lateral direction of the screw cap 51 for presenting sealing action;

59 a coil spring disposed between the outer circumferential surface step part of the right side skirt part 58*d* of the piston 58 and an outside groove part of the lateral cylindrical part 51*e* of the screw cap 51 for energizing the lateral nozzle member 56 in the left direction in the figure; and

60 a cylindrical member held on the protruded part 56*a* of the lateral nozzle member 56 and on the rib-shaped part 57*b* of the output side piece 57 for guiding the piston 58 moving horizontal direction in the figure.

Figure 10:
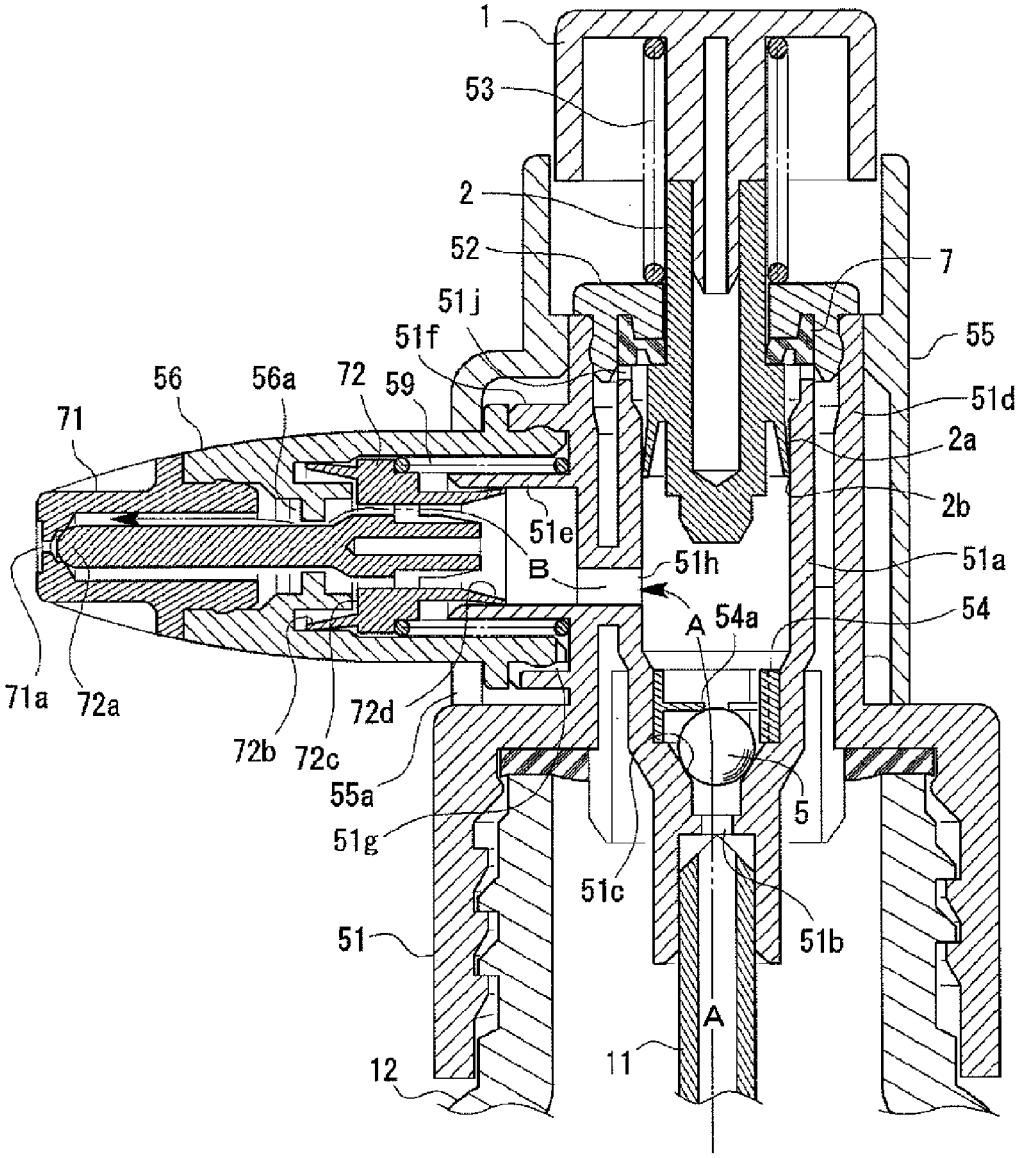
FIG. 10 is a view illustrating the stationary mode of the content discharge mechanism (sixth one: longitudinal upstream passage, lateral downstream passage, longitudinal push button type, tip sealing function, and coil springless of the passage) (Embodiment 7)

Reference numbers 71, 72 used anew in FIG. 10 designated at

71 is an output side piece fitted to and integrated with the opening side of the lateral nozzle member 56;

71*a* a hole for outputting the contents;

72 a pressure storage type piston disposed in the internal space region of the lateral nozzle member 56 and having a chip sealing function for the hole 71*a;*

72*a* a tip end side valve action part for closing the hole 71*a* of the output side piece 71 in the stationary mode in the figure;

72*b* a skirt part on the left side in the figure abutting on the internal circumferential surface of the lateral nozzle member 56 for presenting the sealing action;

72*c* a vertical annular flat surface, part on the base part side of the left side skirt part, for receiving content pressure to the right direction in the figure; and

72*d* a skirt part on the right side in the figure abutting on the internal circumferential surface of the lateral cylindrical part 51*e* of the screw cap 51 to present sealing action.

Figure 11:
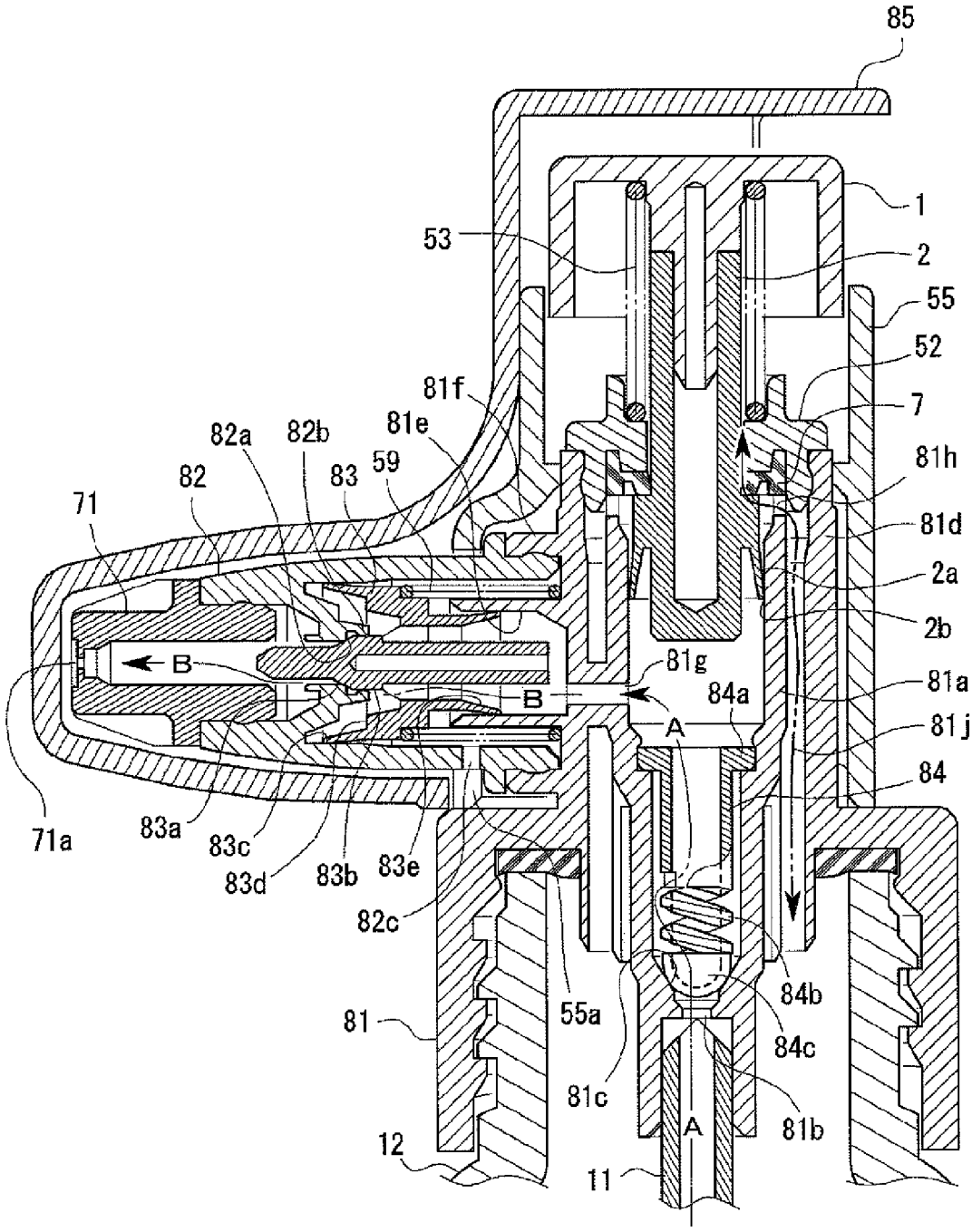
FIG. 11 is a view illustrating the stationary mode of the content discharge mechanism (seventh one: longitudinal upstream passage, lateral downstream passage, longitudinal push button type, coil springless of the passage type, synthetic resin-made suction valve with spring, and cover cap) (Embodiment 8)

Reference numbers 81 to 85 used anew in FIG. 11 designated at

81 is a screw cap threadably mounted on the opening side cylindrical part of the container body 12;

81*a* a longitudinal inside cylindrical part for presenting the same action as the inside cylindrical part 51*a;*

81*b* a hole for content inflow for presenting the same action as the hole 51*b;*

81*c* an annular reception surface for constructing the suction valve and for presenting the same action as the annular reception surface 51*c;*

81*d* a longitudinal outer annular part connected partially circumferentially of an outer circumferential surface of the inside cylindrical part 81*a;*

81*e* a lateral cylindrical part for presenting the same action as the cylindrical part 51*e;*

81*f* a lateral outer annular part formed around the cylindrical part;

81*g* a hole for communication between the upstream passage A and the downstream passage B;

81*h* a recessed missing part formed intermittently circumferentially of an upper end part of the inside cylindrical part 51*a*, through which fresh air (refer to FIG. 8) and the contents (refer to FIG. 9) pass;

81*j* a fresh air passage region (refer to D of FIG. 2) supplied into the container body in the discharge mode;

82 a lateral nozzle member fitted to the lateral outer annular part 5 if of the screw cap 51;

82*a* an annular edge part for presenting the same action as the outer annular part 51*f* of the screw cap 51;

???82*a* an annular edge part for presenting the same action as the annular edge part 8*a* between it and a piston 83 described later;

82*b* an inward annular protrusion part formed on the right side of the annular edge part in the figure so as to be added thereto and constructing a pressure storage discharge valve together with an intermediate outer circumferential surface 83*b* of a piston 83;

82*c* a hole for fresh air communication formed at a portion in a disposition space region of the coil spring 59;

83 a piston disposed in the lateral nozzle member 82 and having a pressure storage type discharge valve function;

83*a* an annular tapered surface constructing the pressure storage type discharge valve together with the annular edge part 82*a* of the lateral nozzle member 82;

83*b* an intermediate outer circumferential surface, part abutting on the right side in the figure of the annular tapered surface, constructing the pressure storage type discharge valve together with the annular protrusion part 82*b* of the lateral nozzle member 82;

83*c* a skirt part on the left side in the figure abutting on the internal circumferential surface of the lateral nozzle member 82 to present sealing action;

83*d* a vertical annular flat surface, part on the base part side of the left side skirt part, for receiving content pressure to the right direction in the figure;

83*e* a skirt part on the right side in the figure abutting on the internal circumferential surface of the lateral cylindrical part 81*e* of the screw cap 81 to present sealing action;

84 a synthetic resin made valve with spring;

84*a* a flange shaped part fitted to and held by the internal circumferential surface step part (recessed part) of the inside cylindrical part 81*a* of the screw cap 81;

84*b* a spiral spring part extending downward from the flange shaped part;

84*c* a semispherical body part abutting on a lower end side of the spring part and constructing the suction valve together with the annular reception surface 81*c*; and

85 a cover cap removable with respect to the cover 55 and the screw cap 81 for protecting the operation button 1 and the output side piece 71 when mounted.

Among the components described above, those excepting the spherical body 5, and the coil springs 6, 10, 26, 43, 48 53, and 59 are synthetic resin made elements consisted of nylon, polyacetal, polyethylene, polypropylene, polyethylene, terephthalate, polybutylene terephthalate, NBR, neoprene, and butyl rubber, etc.

DESCRIPTION OF THE INVENTION

Herein, (1) the stationary mode means that the operation button and the operation lever are not depressed with the discharge valve being closed;

(2) The discharge mode (injection mode) means that the operation button and the operation lever are depressed to open the discharge valve and the sealing action part of the piston moving in the cylinder does not yet proceed up to a facing position of the communication hole (between the upstream passage and the downstream passage).

(3) The discharge finishing mode (injection finishing mode) means that the operation button and the operation lever are further depressed, and the sealing action part of the sheath-shaped piston. For example, interlocking with these operation parts advances to facing positions of the communication hole between the upstream passage and the downstream passage (refer to FIGS. 1 to 3, FIGS. 7 to 11) and up to the facing position of the communication hole (refer to FIGS. 4 to 6) of the accommodation space part of the piston on the sealing action part side and the suction valve accommodation space part on this side of the former to change the discharge valve from "open" up to that time to "close" and returns to the stationary mode by releasing of the discharge operation by a user;

(4) the longitudinal direction means a vertical direction of the container body (e.g., longitudinal direction of the sheath-shaped piston 2 and the coil spring 6 in FIG. 1; and (5) the lateral direction means a direction substantially perpendicular to the vertical direction of the container body (e.g., longitudinal direction of the piston 9 and the coil spring 10 in FIG. 1).

DETAILED DESCRIPTION OF THE INVENTION

Embodiment 1

In the stationary mode in FIG. 1, (1*a*) the operation button 1 and the sheath-shaped piston 2 move upward by the action of the coil spring 6, (1*b*) the suction valve and the discharge valve are closed, and (1*c*) the contents enter the upstream passage A and the downstream passage B (part thereof) extending from the suction valve (at least after a pump type product is used even one time) via the hole 3*f* for communication to the discharge valve.

In the discharge mode in FIG. 2 where the sealing action part 2*b* of the sheath-shaped piston 2 is yet located at an upward position from the hole 3*f* for communication by depressing the operation button 1, (1*d*) in response to lower movement of the sheath-shaped piston 2*a* a volume of the passage of (1*c*) is reduced to gradually raise content pressure there, (1*e*) when the total pressure of the contents in the right direction in the figure received by the annular flat surface 9*c* or the like becomes stronger than driving force to the left direction in the figure of the coil spring 10 or the like to the piston, the piston moves in the right direction in the figure, (1*f*) with the movement, the annular edge part 8*a* of the output side piece 8 of the discharge valve and the annular tapered surface 9*a* of the piston 9, closely making contact up to that time, are separated (the annular reception surface 3*c* of the suction valve and the spherical body 5 are kept closed), (1*g*) by the "opening" of the discharge valve, the contents contained in the passage of (c) are discharged from the hole 8*b* of the output side piece 8 to external space along the flow C.

In the discharge finishing mode in FIG. 3 where the sheath-shaped piston 2 more descends than the position in FIG. 2 and its sealing action part, 2*b* moves to the position of the hole 3*f* for communication, (1*h*) the passage outside space region E and the internal space region of the container body 12 are communicated with the passage of (1*c*) to permit a volume of the content accommodation space region from the suction valve to the discharge valve to be sharply increased compared with the case just before (substantially the state in FIG. 2), (1*j*) with the sharp increase of the volume pressure of the contents in the accommodation space region is sharply reduced, and the total pressure received by the annular flat surface 9*c* of the piston 9 etc. to the right direction in the figure is also reduced, (1*k*) as a result, the piston 9 returns to the left direction in the figure with elastic energizing force of the coil spring 10 in the right direction in the figure to securely "close" the discharge valve that has been opened up to that time.

When a user depresses the operation button 1 (of the stationary mode) by a predetermined stroke in such a way to lower the sealing action part 2*b* of the sheath-shaped piston 2 up to the position of the hole 3*f* for communication, the operation instantaneously changes from the discharge mode to the discharge finishing mode.

When the user stops the depressing operation of the operation button 1, i.e., the user takes off his or her finger from the operation button 1, the operation button and sheath-shaped piston 2 returns upward with the elastic energizing force of the coil spring 6.

At this time, the volume of the passage of the (1*c*) is increased to permit the passage to become negative pressure with respect to the internal space of the container body 12, so that the spherical body 5 moves upward by receiving the content pressure on the container body side to "open" the suction valve. The discharge valve is kept closed.

As a result, the contents in the container body 12 flow into the passage of the (1*c*) after passage through the tube 11 and the hole 3*b* so that when the content pressure in the passage and self weight of the spherical body 5 applied downward to the spherical body 5 exceeds the content pressure on the container body side applied upward to the spherical body 5, the spherical body settles down to make contact with the annular reception surface 3*c*. This permits the suction valve to be closed and the operation to return to the stationary mode of FIG. 1.

Following the pressing operation of the operation button 1 the annular rubber 7 is dragged downward in its inside edge part by the sheath-shaped piston 2 in the form of its bowing head.

For this, the degree of contact between the annular rubber 7 and the outer circumferential surface the sheath-shaped piston 2 becomes small ensuring slight gap. Hence in the case of at least the discharge mode of FIG. 2, fresh air is supplied to the container body by a flow D passing the gap—the recessed missing part of the inside cylindrical part—the passage region between the inside cylindrical part and the outside upper cylindrical part 3*d*. This compensates pressure lowering in the internal space region of the container body 12.

Assembling work of other components to the screw gap 3 of FIG. 1 is as follows. For example, (s11) the spherical body 5, coil spring 6, and sheath piston 2 is set in the inside cylindrical part 3*a*, and the annular rubber 7 and the cover structure 4 are mounted on the outer annular part 3*d* etc. from above, and thereafter the operation button 1 is fitted to the sheath-shaped piston 2, (s12) the coil spring 10 and the piston 9 are set in the lateral nozzle 3*e*, and the output side piece 8 is mounted on the opening part side of the nozzle, and (s13) the tube 11 is mounted on the lower end opening part of the inside cylindrical part 3*a*. The order of working units of the (s11) to (s13) is arbitrary.

Embodiment 2

A content discharge mechanism in FIG. 4 is basically different from that of FIG. 1 as follows:

(21) A rotary type operation lever (trigger lever) is employed instead of the operation type 1 of depression type.

(22) When turning operation of the trigger lever in an illustrated clockwise direction of the trigger lever (discharge mode setting operation) is performed, there are provided a lateral sheath-shaped piston interlocking with the trigger lever and a coil spring for energizing the piston in the illustrated right direction (stationary mode position).

(23) As the discharge member on which the output side piece 8 is mounted there is provided a lateral nozzle member independent from the screw cap in FIG. 1.

(24) A restriction piece is formed on the cap for restricting the amount of upward movement of the spherical body 5.

In the stationary mode in FIG. 4, (2*a*) the sheath-shaped piston 22 moves in the illustrated right direction owing to the action of the coil spring 26, and the operation lever 21 interlocking via the sheath-shaped piston and the rib-shaped piston 21*b* is in an initial state where it is turned anticlockwise, (2*b*) the suction valve and the discharge valve are closed, and (2*c*) the contents enter the upstream passage A and the downstream passage B (part thereof) extending from the suction valve via the holes 23*d*, 23*k* to the discharge valve.

When a user sets the hole 8*b* of the output side piece 8 for example to a mouth thereof and then turns the operation lever 21 clockwise, the sheath-shaped piston 22 is pushed by the rib-shaped part 21*b* and moves in the illustrated left direction against the elastic energizing force of the coil spring 26 into the discharge mode (not shown).

More specifically, by the movement of the sheath-shaped piston 22 in the left direction, in the same manner as in the case of FIG. 2, (2*d*) the volume of the passage of the 2(*c*) becomes small and the content pressure thereof is gradually raised, (2*e*) When the total pressure of the contents in the illustrated right direction received by the annular flat surface 9*c* of the piston 9 becomes stronger than the driving force in the illustrated left direction of the coil spring 10 or the like to the piston, the piston moves in the illustrated right direction, (2*f*) with the movement, the annular edge part 24*a* of the lateral nozzle member 24 of the discharge valve and the annular tapered surface 9*a* of the piston 9, both in close contact with each other up to that time are separated (the annular reception surface 27*a* of the suction valve and the spherical body 5 are kept closed), and (2*g*) with "opening" of the discharge valve the contents accommodated in the passage of the (2*c*) up to that time are discharged to external space from the hole 8*b* of the output side piece 8.

The mode of fresh air supply into the container inside from the passage region 23*j* in the discharge mode is the same as the flow D in FIG. 2.

In the discharge finishing mode where the sealing action part 22*b* of the sheath-shaped piston 22 moves up to the position of the hole 23*d*, the operation, as in FIG. 3, instantaneously changes from the discharge mode up to that time to the discharge finishing mode.

Once the user stops the turning operation of the operation lever 21, the operation lever and the sheath-shaped piston 22 returns in the illustrated right direction with the elastic energizing force of the coil spring 26 and changes to the stationary mode in FIG. 4.

As illustrated in the description of the discharge finishing mode in FIG. 3, the contents in the container body 12 enter the passage of the (2*c*) via the tube 11 on the middle of the change to the stationary mode.

Assembling work of other components to the screw cap 23 in FIG. 4 is for example as follows:

(s21) The housing 27 in the state where the spherical body 5 and the tube 11 are set is fitted to the annular protruded part 23*f*.

(s22) The coil spring 26 and the sheath-shaped piston 22 are set in the rear side lateral cylindrical part 23*b* are set, and in this state, the annular rubber 7 and the reception side piece 25 are mounted on the lateral cylindrical part and the outer annular part 23*h* etc. from the illustrated right side.

(s23) The coil spring 10 and the piston 9 are set in the front side lateral cylindrical part 23*c*, and in this state the lateral nozzle member 24 (into which the output side piece 8 is assembled) is mounted on the annular recessed part 23*g* etc.

(s24) The rotary shaft 21*a* of the operation lever 21 is mounted in the pair of the recessed parts 24*d* of the lateral nozzle member 24.

The order of execution of the working units of (s21) to (s24) is arbitrary under the conditions where the work of (s24) is performed after (s22) and (s23).

Embodiment 3

The content discharge mechanism in FIG. 5 is basically different from that in FIG. 4 as follows:

(31) a longitudinal nozzle member is used instead of the lateral nozzle member 24 in FIG. 4;

(32) a piston 9 presenting discharge valve action between it and the longitudinal nozzle member and a coil spring 10 for energizing the piston upward are provided vertically; and (33) the whole of the upstream passage A and downstream passage B are made substantially vertically linear.

In the stationary mode in FIG. 5, (3*a*) the sheath-shaped piston 22 is moved in the illustrated right direction by the action of the coil spring 26 and the operation lever 21 interlocking via the sheath-shaped piston and the rib-shaped part 21*b* is in an initial state where it is turned anticlockwise;

(3*b*) the suction valve and the discharge valve are closed;

(3*c*) the contents are contained in the upstream passage A and the downstream passage B (part thereof) extending from the suction valve (after a pump type product is used at least even once) via the holes 31*d*, 31*k* to the discharge valve.

When a user sets the hole 8*b* of the output side pierce 8 to a nose hole or the like and then the operation lever 21 is turned clockwise, the sheath-shaped piston 22 is pressed to the rib-shaped part 21*b* and is moved in the illustrated left direction against the elastic energizing force of the coil spring 26 to change to the discharge mode (not shown).

More specifically, by the movement of the sheath-shaped piston 22 to the left direction, in the same manner as in the case in FIG. 2, (3*d*) the volume of the passage of (3*c*) is reduced and the pressure of the contents there is gradually raised;

(3*e*) when the total pressure of the contents to the illustrated lower direction received on the annular flat plane 9*c* of the piston 9 becomes larger than the driving force of the coil spring 10 or the like to the piston to the illustrated upper direction, the piston moves in the illustrated lower direction;

(3*f*) with the movement, the annular edge part 32*a* of the longitudinal and lateral nozzle members 32 of the discharge valve and the annular tapered surface 9*a* of the piston 9, both in close contact up to that time, are separated (the annular reception surface 27*a* of the suction valve and the spherical surface 5 are kept closed);

(3*g*) by the "opening" of the discharge valve the contents contained till then in the passage of (3*c*) is discharged to external space from the hole 8*b* of the output side piece 8.

The state of fresh air supply from the passage region 23*j* into the container in the discharge mode is the same as the flow D in FIG. 2.

In the discharge finishing mode where the sealing action part 22*b* of the sheath-shaped piston 22 is moved to the position of the hole 31*d*, as in FIG. 3, the operation is instantaneously changed from the discharge mode till then to the discharge finishing mode.

Once the user stops the turning operation of the operation lever 21, the operation lever and the sheath-shaped piston 22 are restored in the illustrated right direction with the elastic energizing force of the coil spring 26 and changes to the stationary mode in FIG. 5.

As described in the discharge finishing mode in FIG. 3, the contents in the container body 12 flow into the passage of (3*c*) via the tube 11 in the course of the change to the stationary mode.

The assembling work of other components to the screw cap 31 in FIG. 5 is, for example, as follows:

(s31) the housing 27 in the state where the spherical body 5 and the tube 11 are set is fitted to the annular protruded part 31*f;*

(s32) in the state where the coil spring 26 and the sheath-shaped piston 22 are set in the intermediate sheath-shaped part 31*b*, the annular rubber 7 and the reception side piece 25 are mounted on the intermediate sheath shaped part and the outer annular part 31*h* or the like from the illustrated right direction;

(s33) in the state where the coil spring 10 and the piston 9 are set in the upper longitudinal cylindrical part 31*c*, a longitudinal nozzle member 32 (in which the output side piece 8 is incorporated) is mounted on the outer annular part 31*g;*

(s34) and the rotary shaft 21*a* of the operation lever 21 is mounted on the pair of the recessed parts 32*d* of the longitudinal nozzle member 32.

The order of execution of the working units of (s31) to (s34) is arbitrary under the conditions where the work of (s34) is performed after (s32) and (s33).

Embodiment 4

The content discharge mechanism in FIG. 6 is basically different from that in FIG. 5 as follows:

(41) an operation button of a lateral press type is used instead of the operation lever 21 of the rotation type; and

(42) the coil springs 43, 48 individually energizing the operation button 41 and the piston 47 are provided outside the content passage, respectively.

Using the so-called outer spring as the energizing member of the piston 9 and the sheath-shaped piston 22 as described above makes it possible to reduce the degree of contact of the contents, a discharge object with any metal to the utmost, hereby preventing the contents from being changed owing to contact with metal.

In the stationary mode in FIG. 6, (4*a*) the operation button 41 and the sheath-shaped piston 42 are in the initial state where they moved in the illustrated right direction by the action of the coil spring 43;

(4*b*) the suction valve and the discharge valve are closed; and (4*c*) the contents are contained in the upstream passage A and the downstream passage B (part thereof) extending from the suction valve (after a pump type product is used at least even once) via the holes 44*d* and 44*k* to the discharge valve.

when a user sets the hole 8*b* of the output side piece 8, for example, into a nose hole and then pushes the operation button 41 in the illustrated left direction, the sheath-shaped piston 42 is moved in the illustrated left direction against the elastic energizing force of the coil spring 43 into the discharge mode (not shown).

More specifically, by the movement of the sheath-shaped piston 42 in the left direction, as in the case of FIG. 2, (4*d*) the volume of the passage of (4*c*) is reduced and the content pressure within is gradually raised;

(4*e*) when the total pressure of the contents to the illustrated lower direction received on the annular flat surface 47*d* of the piston 47 becomes larger than the driving force of the coil spring 48 or the like to the piston to the illustrated upper direction, the piston moves in the illustrated lower direction;

(4*f*) by the movement, the annular edge part 46*a* of the cylindrical body 46 of the discharge valve and the annular tapered surface 47*a* of the piston 47, both in close contact till then, are separated (the annular reception surface 27*a* of the suction valve and the spherical body 5 are kept closed);

(4*g*) by the opening of the discharge valve the contents contained in the passage of (4*c*) are discharged to external space from the hole 8*b* of the output side piece 8.

The state of fresh air supply from the passage region 44*j* into the container in the discharge mode is the same as in the flow D in FIG. 2.

Further, in the discharge finishing mode where the sealing action part 42*b* of the sheath-shaped piston 42 moves up to the position of the hole 44*d*, the operation changes instantaneously, as in the same manner as in FIG. 3, from the discharge mode till then to the discharge finishing mode.

Once the user stops the press operation of the operation button 41, the operation button and the sheath-shaped piston 42 are restored in the illustrated right direction with the elastic energizing force of the coil spring 43 into the stationary mode in FIG. 6.

As described in the discharge finishing mode of FIG. 3, the contents in the container body 12 flow into the passage of (4*c*) via the tube 11 in the course of the change to the stationary mode.

Assembling work of other components to the screw cap 44 in FIG. 6 is, for example, as follows:

(s41) the housing 27 in the state where the spherical body 5 and the tube 11 are set is fitted to the annular protruded part 44*f;*

(s42) a unit in which the annular rubber 7, reception side piece 25, operation button 41, sheath-shaped piston 42, and coil spring 43 are incorporated is mounted on the intermediate sheath-shaped part 44*b* and the outer annular part 44*h* or the like from the illustrated right direction; and (s43) the piston 47 is set inside the upper longitudinal cylindrical part 44*c* and the coil spring 48 is set outside the same, and in this state the longitudinal nozzle member 45 is mounted on the outer annular part 44*g* (in which the output side piece 8 is incorporated). The order of execution of the working units of (s41) to (s43) is arbitrary.

Embodiment 5

In the content discharge mechanism in FIGS. 5 and 6 a position relation of the hole 31*k* and the hole 31*d* in the illustrated left and right directions and a position relation of the hole 44*k* and the hole 44*d* in the illustrated left and right directions may be reversed.

In this case, the hole 31*d* and the hole 44*d* act as a simple hole for communication.

In contrast, the hole 31*k* and the hole 44*k* release a sealing state between the sealing action parts 22*b*, 42*b* (part thereof) of the sheath-shaped pistons 22, 42 and the intermediate sheath-shaped parts 31*b*, 44*b* to change the discharge mode till then to the discharge finishing mode.

This is because when the sealing action parts 22*b*, 42*b* of the sheath pistons 22, and 42 in the discharge mode move in the illustrated left direction, they reach the hole 31*k* and the hole 44*k*.

More specifically, when the sealing action parts 22*b*, 42*b* of the sheath-shaped pistons 22, 42 reach the hole 31*k* and the hole 44*k*, as described above (refer to FIG. 3), (1*h*)' the passage outside space region E and the internal space region of the container body 12 are communicated with the passage of (1*c*) and a volume of the content containing space region from the suction valve to the discharge valve is rapidly increases compared with the state just before (substantially the state in FIG. 2), (1*j*)' by the rapid increase of the volume pressure of the contents in the containing space region is rapidly reduced and the total pressure received in the illustrated lower direction by the annular flat surface 9*c* of the piston 9 is also reduced, and (1*k*)' as a result, the piston 9 is restored in the illustrated upper direction with the elastic energizing force of the coil spring 10, and the discharge valve opened up to that time is securely "closed".

Embodiment 6

The content discharge mechanism of FIGS. 7 to 9 is basically different from that in FIG. 1 as follows:

(51) Coil springs 53, 59 for individually energizing the operation button 1 and the downstream side piston 58 are provided in the outside space region of the content passage, respectively; and (52) a tip sealing function is provided for the hole 57*a* for outputting the contents.

By using the so-called outer spring as the energizing member of the operation button 1 and the piston 58 it is possibly reduced for the contents, a discharge object to make contact with metal and the contents are prevented from being changed owing to contact with metal.

Further, by directly opening and closing the hole 57*a* for outputting the contents the residual contents in a passage or the like in the vicinity of the hole are prevented from flowing out of the hole after the operation is restored from the discharge mode to the stationary mode.

In the stationary mode in FIG. 7, (5*a*) the operation is in an initial state where the operation button 1 and the sheath-shaped piston 2 integral with the former are moved in the illustrated upper direction by the action of the coil spring 53;

(5*b*) the suction valve and the discharge valve are closed; and (5*c*) the contents are contained in the upper passage A and the lower passage B (part thereof) extending from the suction valve (after the pump type product is used at least even once) via the hole 51*h* to the discharge valve.

When a user sets the hole 57*a* of the output side piece 57 for example to a mouth for example and then depresses the operation button 1 downward, the sheath-shaped piston 2 moves in the illustrated lower direction resisting the elastic energizing force of the coil spring 53 into the discharge mode in FIG. 8.

More specifically, by the downward movement of the sheath-shaped piston 2

(5*d*) a volume of the passage of (5*c*) is reduced to gradually raise the pressure of the contents there;

(5*e*) At the time, the total pressure of the contents in the illustrated right direction received by the annular flat surface 58*c* of the piston 58 becomes higher than the driving force of the coil spring 59 in the illustrated left direction to the piston, the piston moves in the illustrated right direction;

(5*f*) by the movement, the hole 57*a* of the output side piece 57 of the discharge valve and the tip end side valve action part 58*a* of the piston 58, both in close contact till then, are separated (the annular reception surface 27*a* of the suction valve and the spherical body 5 are kept closed); and (5*g*) by the opening of the discharge valve the contents contained till then in the passage of (5*c*) are discharged to external space from the hole 57*a* of the output side piece 57 through the flow C.

In the discharge mode fresh air supply by the flow D into the container is performed likewise the case in FIG. 2.

Further, in the discharge finishing mode in FIG. 9 where the sealing action part 22*b* of the sheath-shaped piston 22 moves to the position of the hole 23*d*, the operation changes instantaneously from the discharge mode till then to the discharge finishing mode likewise FIG. 3.

Once a user stops pressing operation to the operation button 1, the operation button and the sheath-shaped piston 2 are restored in the illustrated upper direction with the energizing force of the coil spring 53 and are changed to the stationary mode in FIG. 7.

When restoring from the discharge finishing mode in FIG. 9 to the stationary mode in FIG. 7, as described in FIG. 3, the suction valve of the spherical body 5 is once opened and the contents in the container body 12 flow into the passage of (5*c*) therefrom.

The assembling work of other components for the screw cap 51 in FIG. 7 is, for example, as follows:

(s51) The piston 58 is set inside the lateral cylindrical part 51*e* and the coil spring 59 is set outside, and in this state a lateral nozzle member 56 (in which the output side piece 57 is incorporated) is fitted to the lateral outer annular part 51*f;*

(s52) the cover body 55 is fitted to the longitudinal outer annular part 51*d;*

(s53) the spherical body 5 and the spherical body press member 54 are mounted in the inside cylindrical part 51*a;*

(s54) a unit in which the operation button 1, sheath-shaped piston 2, annular rubber 7, reception side piece 52, and coil spring 53 are incorporated is fitted to the inside cylindrical part 51*a* and the outer annular part 51*d* or the like from above in the figure; and (s55) the tube 11 is mounted on a lower end opening part of the inside cylindrical part 51*a.*

The order of execution of working units of (s51) to (s55) is arbitrary under the conditions that the work of (s52) is performed after (s51), and the work of (s54) is performed after (s52) and (s53).

Embodiment 7

The content discharge mechanism of FIG. 10 is basically different from that of FIG. 7 as follows:

(61) Instead of the output side piece 57 of FIG. 7 there is used an output side piece 71 of the shape where the side of the hole 57*a* is more actively protruded than a tip end of the lateral nozzle member 56;

(62) instead of a pressure storage type piston 58 in FIG. 7 there is used a piston 72 in the form where a tip end side valve action part 58*a* thereof (when the stationary mode) abuts on the hole of the output side piece; and (63) the cylindrical member 60 mounted in the output side piece 57 is not used.

The description of the operation in the stationary mode, discharge mode, and discharge finishing mode of the content discharge mechanism in FIG. 10 is the same as that of each in FIGS. 7 to 9.

That is, terms with respect to the output side piece 57 and the piston 58 in the description of FIGS. 7 to 9 are made to correspond to an "output side piece 71 and a "piston 72". Contents thereof are also adequate as the description of operation of the content discharge mechanism in FIG. 10.

Further, assembling work of other components to the screw cap 51 in FIG. 10 is the same as that in FIG. 7.

Embodiment 8

The content discharge mechanism in FIG. 11 is basically different from the one in FIG. 10 as follows:

(71) A tip sealing function for the hole 71*a* of the output side piece 71 in FIG. 10 is neglected;

(72) instead of the spherical body 5 and spherical body press member 54 in FIG. 10 there is used a synthetic resin-made valve with spring;

(73) a double sealing function is imparted to the discharge valve; and (74) a cover cap is provided for the press button, lateral nozzle member, and output side piece.

By intending that energizing members of the operation button 1 and the piston 83 are made to be outer springs and additionally thereto the suction valve is made of a synthetic resin, the possibility that the contents that are a discharge object make contact with metal is eliminated and so the contents are more securely prevented from being changed owing to contact with metal.

Further, by making the discharge valve a double structure the contents in the stationary mode are more securely prevented from leaking to external space.

In the stationary mode in FIG. 11, (6*a*) by the action of the coil spring 53, the operation is in an initial state where the operation button 1 and the sheath-shaped piston 2 integral therewith are moved in the illustrated upper direction;

(6*b*) the suction valve and the discharge valve are closed; and (6*c*) the contents are contained in the upstream passage A and the downstream passage B (part thereof) extending from the suction valve (after a pump type product is used at least even once).

When a user removes the cover cap 85 from the cover body 55 and the screw cap 81 etc. and, after the hole 57*a* of the output side piece 57 for example is set to a mouth for example, the operation button 1 is depressed downward, the sheath-shaped piston 2 moves in the illustrated lower direction against the elastic energizing force of the coil spring 53 to result in the discharge mode (refer to FIG. 8).

More specifically, by the downward movement of the sheath-shaped piston 2, (6*d*) the volume of the passage of (6C) is reduced and pressure of the contents there is gradually raised;

(6*e*) the piston moves in the illustrated right direction when the total pressure of the contents to the illustrated right direction received by the annular flat surface 83*d* of the piston 83 becomes larger than the driving force of the coil spring 59 to the illustrated left direction to the piston;

(6*f*) by the movement, a portion between the annular edge part 82*a* of the lateral nozzle member 82 and the annular tapered surface 83*a* of the piston 83 and a portion between the annular protruded part 82*b* of the lateral nozzle member 82 and an intermediate outer circumferential surface 83*b* of the piston 83 of the double discharge valve in close contact up to that time are separated (the annular reception surface 27*a* of the suction valve and the spherical body 5 are kept closed); and (6*g*) by the "opening" of the double discharge valve, the contents contained in the passage of (6*c*) till then are discharged into external space from the hole 71*a* of the output side piece 71.

The state of fresh air supply from the passage region 81*j* into the container in the discharge mode is the same as the D in FIG. 2.

In the discharge finishing mode where the sealing action part 2*b* of the sheath-shaped piston 2 moves up to the position of the hole 81*g* the operation is instantaneously changed from the discharge mode till then to the discharge finishing mode as in the case in FIG. 3.

When a user stops depressing of the operation button 1, the operation button and the sheath-shaped piston 2 is restored in the illustrated upper direction by the elastic energizing force of the coil spring 53 to change to the stationary mode in FIG. 11.

Further, as described in the discharge finishing mode of FIG. 3, the contents in the container body 12 flow into the passage of (6*c*) after passage through the tube 11, the hole 81*b*, and the opened suction valve or the like in the course to the change to the stationary mode.

Assembling work of other components to the screw cap 51 in FIG. 11 is the same at that in FIG. 7.

Embodiment 9

The contents in the container include as objects varieties of properties such as liquid, foamable (foam-like), pasty, gel, powdery.

Pump type products to which the present invention is applicable include various applications such as cleansing agents, cleaning agents, antiperspirants, coolants, muscle antiphlogistic agents, hair styling agents, hair treatment agents, hair washing agents, hair restorers, cosmetics, shaving foams, foods, droplet like products (such as vitamin), medical goods, quasi drugs, coating materials, gardening agents, repellant agents (insecticides), cleaners, deodorants, laundry starch, urethane foams, extinguishers, adhesives, lubricant agents or the like.

Contents accommodated in the container body include powdery products, oil components, alcohols, surfactants, high polymers, and effective components associated with various applications.

Powdery products includes metal salts powder, inorganic powder, and resin powder or the like, e.g. talc, kaolin, aluminum hydroxychloride (aluminum salt), calcium arginate, powdered gold, silver powder, mica, carbonate, barium sulphate, cellulose, and mixtures of them.

Oil components include silicone oil, palm oil, eucalyptus oil, camellia oil, olive oil, jojoba oil, paraffin oil, myristic acid, palmitic acid, stearic acid, linoleic acid, linolenic acid or the like.

Alcohols include monovalent lower alcohol such as ethanol, monovalent higher alcohol such as lauryl alcohol, and multivalent alcohol such as ethylene grycol or the like.

Surfactants include anionic surfactant such as sodium laurylsulphate, non-ionic surfactant such as polyoxiethylene oleyl ether, amphoteric surfactant such as lauryl dimethyl amino acetic acid betaine, and cationic surfactant such as alkylchloride trimethylammonium or the like.

Polymer molecule compounds include methylcellulose, gelatine, starch, and casein or the like.

Effective components associated with respective applications include antiphlogistics/analgesics such as methyl salicylate and indometacin, bactelia elimination agents such as sodium benzoate and cresol, harmful insect extermination agents such as pyrethroid, diethyltoluamide, anhidrotics such as zinc oxide, algefacient such as camphor and peppermint camphor, antiasthmatic agents such as ephedrine and adrenaline, edulcorant such as sucralose and aspartame, adhesive and paint such as epoxy resin and urethane, dyes such as paraphenylenediamine and aminophenol, and extinguishant such as ammonium dihydrogenphosphate and sodium/potassium acid carbonate or the like.

Further, there are usable suspensions, UV absorbers, emulsifiers, humectants, antioxidants, and metal ion blocking agents, etc.

What is claimed is:

1. A content discharge mechanism of a pump type container comprising:

an operation part located on top, a first cylindrical part having an inner surface comprising:

a piston having an annular sealing part formed on the outer surface of said piston and interlocking with said operation part;

a suction valve actuated in response to the movement of the piston;

a means for elastically energizing the operation part in the longitudinal direction with respect to the operation part;

an upstream side passage formed between said piston and said suction valve;

a second cylindrical part perpendicular to the first cylindrical part comprising:

a discharge outlet;

a downstream side passage reaching said discharge outlet from a communication hole with said upstream side passage, said communication hole formed in the perpendicular intersection of said first cylindrical part and said second cylindrical part;

a movable discharge valve provided on said downstream side passage, acting on said discharge outlet and having a means for elastically energizing in the lateral direction with respect to the operation part; and a discharge outlet setting member integrated with an opening cap of the container for setting said discharge outlet in the state where it does not move even at the time of the actuation of said operation part, wherein said annular sealing part of said piston advances together with said operation part from its stationary mode and the content discharge mechanism is not shifted from a discharge mode to a discharge finishing mode until the annular sealing part reaches the communication hole.

2. A content discharge mechanism of a pump type container according to claim 1 wherein said discharge valve is of a pressure storage type.

3. A content discharge mechanism of a pump type container according to claim 1 wherein said upstream passage comprises a space region corresponding to a longitudinal direction of a container body and said downstream passage comprises a space region corresponding to a lateral direction of the container body.

4. A content discharge mechanism according to claim 1, wherein a first elastic member for energizing said piston to a stationary mode position and a second elastic member for energizing said discharge valve to a closed state are disposed outside said upstream passage and the downstream passage.

5. A content discharge mechanism according to claim 1, wherein said suction valve further comprises a movable part equipped with an elastic member entirely made of a synthetic resin for energizing said suction valve to a closed state.

6. A content discharge mechanism according to claim 1, wherein said device is secured to a container.

* * * * *